United States Patent [19]

Yamashita

[11] Patent Number: 5,014,428

[45] Date of Patent: May 14, 1991

[54] ROTARY TYPE ELECTRIC RAZOR

[75] Inventor: Yasuo Yamashita, Iizuka, Japan

[73] Assignee: Kyushu Hitachi Maxell, Ltd., Fukuoka, Japan

[21] Appl. No.: 487,839

[22] Filed: Mar. 5, 1990

[30] Foreign Application Priority Data

Mar. 6, 1989 [JP] Japan ..... 1-54240
Jan. 30, 1990 [JP] Japan ..... 2-21152

[51] Int. Cl.[5] ..... B26B 19/14; B26B 19/20; B26B 29/16

[52] U.S. Cl. ..... 30/43.6; 30/43; 30/43.5

[58] Field of Search ..... 30/43.1, 43, 43.3, 43.4, 30/43.5, 43.6, 346.51

[56] References Cited

U.S. PATENT DOCUMENTS

| | | | |
|---|---|---|---|
| 2,242,405 | 5/1941 | Sussman | 30/43 |
| 4,043,036 | 8/1977 | Stevens, Sr. et al. | 30/43.6 |
| 4,531,287 | 7/1985 | Shibata | 30/43.6 |
| 4,606,122 | 8/1986 | Ullmann et al. | 30/43.6 |
| 4,675,997 | 6/1987 | Nakagawa | 30/43 |
| 4,707,915 | 11/1987 | Bakker et al. | 30/43.6 |
| 4,811,484 | 3/1989 | Wijma et al. | 30/43.6 |
| 4,894,912 | 1/1990 | Tietjens | 30/43.6 |

FOREIGN PATENT DOCUMENTS

| | | |
|---|---|---|
| 0279965 | 8/1988 | European Pat. Off. . |
| 875369 | 9/1942 | France . |
| 931726 | 3/1948 | France . |
| 204018 | 4/1939 | Switzerland . |
| 304814 | 1/1955 | Switzerland . |

*Primary Examiner*—Douglas D. Watts
*Assistant Examiner*—Paul M. Heyrana, Sr.
*Attorney, Agent, or Firm*—Wenderoth, Lind & Ponack

[57] ABSTRACT

The present invention is directed to a rotary type electric razor which includes an arch-shaped external cutting edge detachably mounted on an upper side of a main body case, an internal cutting edge driving unit supported for free vertical movement with respect to the main body case, and a motor speed detecting means provided within the main body case. The internal cutting edge driving unit comprises a rotary internal cutting edge which rotates in sliding contact with respect to the internal face of the external cutting edge, an internal cutting edge driving chassis for rotatably supporting the rotary internal cutting edge, a motor mounted on the internal cutting edge driving chassis, and a drive transmitting means for transmitting the output of the motor to the rotary internal cutting edge. The motor speed detecting means comprises a rotary member mounted to the output shaft of the motor, and a photosensor opposite the rotary member.

21 Claims, 20 Drawing Sheets

ROTARY TYPE ELECTRIC RAZOR

BACKGROUND OF THE INVENTION

The present invention generally relates to a rotary type electric razor.

Generally, there are some rotary type electric razors which include an internal cutting edge driving unit with a rotary internal cutting edge, a motor and a drive transmitting means for transmitting the motor output to the rotary cutting edge being integrally engaged with an internal driving chassis. The internal cutting edge is adapted to be brought into closer contact with the internal surface of the external cutting edge with the internal cutting edge driving unit being normally urged to be pushed up with a leaf spring within the main body case (literature cited not known).

Further, there are other reciprocating type electric razors as described in, for example, Japanese Laid-Open Patent Application No. 61-62381, wherein the number of revolutions of the driving motor is normally detected in order to retain the speed of the motor despite the light weight variation of the load to make it possible to effect the shaving operation under optimum conditions.

Further, there are some detecting means for detecting the number of revolutions of the motor of the electric razor as shown in, for example, Japanese Laid-Open Utility Model Application No. 62-10880, wherein a non-contact type reflection photosensor is used to detect reflection marks on the output shaft of the motor so as to detect the number of revolutions of the motor (i.e. motor speed) in accordance with the pulse-shaped output from the photosensor.

A problem occurs, however, when a non-contact type of revolution number sensor for detecting revolution of the motor output shaft is engaged in a rotary type electric razor. That is, the internal edge driving unit is required to be moved straight in the vertical direction so as to avoid detection errors. When the motor output shaft is tilted during vertical motion of the internal cutting edge driving unit, the position shift with respect to the opposing photosensor results in detection errors.

In the rotary type electric razor, the internal cutting edge driving unit is simply supported by only a leaf spring within the main body case when the internal cutting edge driving unit is engaged in a condition where it is normally urged to be pushed up into the main body case, such that it is unstable with respect to positional control in the longitudinal and right and left directions. When the external cutting edge is moved between a position pressed against the skin and a position away from the skin, the internal cutting edge driving unit which includes the motor is caused to move vertically and becomes inclined due to variations in the pressing position and the pressing force. The rotary member to be detected by the photosensor can slip out of place so that errors in detecting the number of revolutions of the motor by the photosensor are likely.

SUMMARY OF THE INVENTION

Accordingly, the present invention has been developed with a view to substantially eliminating the above discussed drawbacks inherent in the prior art rotary type electric razors of any of the above-mentioned systems and has for its essential object to provide an improved rotary type electric razor.

Another important object of the present invention is to provide an improved rotary type electric razor of the type referred to above, which is improved in its ability to guide the internal cutting edge driving unit for movement relative to a photosensor of a motor revolution number detecting means while allowing the internal cutting edge driving unit to move freely in the vertical direction, in such a manner that the accuracy in detecting the motor revolution number (or motor speed) is improved.

A further object of the present invention is to provide an improved rotary type electric razor of the type referred to above, which is improved in that the structure for supporting the internal cutting edge for vertical movement is such that a rotating test for the internal cutting edge can be easily carried out before assembling it into a body case, in order to improve efficiency for assembling the internal cutting edge driving unit.

In accomplishing these and other objects, according to one preferred embodiment of the present invention, there is provided a rotary type electric razor which includes an arch-shaped external cutting edge detachably engaged on the upper side of the main body case, an internal cutting edge driving unit supported for free vertical movement with respect to the main body case, and a motor revolution number detecting means provided within the main body case, as shown in FIGS. 1(*a*) and (*b*).

The internal cutting edge driving unit comprises a rotary internal cutting edge which rotates in sliding contact with the internal face of the external cutting edge, an internal cutting edge driving chassis for rotatably supporting the rotary internal cutting edge, a motor mounted on the internal cutting edge driving chassis, and a drive transmitting means for transmitting the output of the motor to the rotary internal cutting edge.

The motor revolution number detecting means is composed of a rotary member to be detected which is engaged with the output shaft of the motor, and also, a photosensor opposite the rotary member.

A vertical motion guiding means for preventing movement other than in the vertical direction of the internal cutting edge driving unit (i.e. movements in the longitudinal and right and left directions) is disposed between the peripheral face of the motor and the internal face of the main body case.

Even when skin is pressed with great force or locally against the external cutting edge, the internal cutting edge driving unit moves straight in only the vertical direction, without longitudinal or right and left inclination, due to the position regulation of the vertical motion guiding means. Therefore, despite the vertical motion of the internal cutting edge driving unit, the distance between the photosensor and the rotary member on the output shaft of the motor, as well as the relative position and angle of the photosensor with respect to the central shaft of the rotary member can be maintained constant so as to prevent errors in detecting the motor speed.

In addition, according to the rotary type electric razor of the present invention, there is provided an internal cutting edge unit comprising a rotary internal cutting edge, an internal cutting edge supporting frame, a passive means, and a transmitting means. The rotary internal cutting edge is able to rotate by receiving the rotating force of the motor by way of the passive means prior to assembly of the float supporting member and the motor into one unit, to thereby enable the rotational condition and efficiency of the rotary internal cutting edge to be checked before assembly thereof with the motor. Thereafter, the internal cutting edge unit is assembled with the motor and float supporting member to form an internal operation unit. This operation unit is then adapted to be fixedly mounted to the main body case by way of the float supporting member for assembly thereof into one unit, so that the rotary internal cutting edge can be easily assembled into the main body case after its rotational condition and efficiency is checked.

BRIEF DESCRIPTION OF THE DRAWINGS

These and other objects and features of the present invention will become apparent from the following description taken in conjunction with the preferred embodiment thereof with reference to the accompanying drawings, in which:

FIG. 1(*b*) is a front view of the portions of FIG. 1(*a*);

FIG. 2 is a perspective view of a rotary type electric razor;

FIG. 3 is a longitudinal-section front view of the razor of FIG. 2;

FIG. 4 is a longitudinal-section side view of the razor of FIG. 2;

FIG. 5 is an exploded perspective view of the razor of FIG. 2;

FIG. 6 is an exploded perspective view of a protective cap and an external cutting edge holder;

FIG. 7 is an exploded perspective view of an internal cutting edge driving unit;

FIG. 8 is a sectional view of an external cutting edge holder;

FIG. 9 is a sectional view showing an internal cutting edge unit;

FIG. 10(*a*) is a front view of a brush for use in cleaning;

FIG. 10(*b*) is a perspective view showing the manner of using the brush;

FIG. 11 is a side view of a flock storing chamber;

FIG. 12 is a sectional view of the flock storing chamber with the shutter being closed;

FIG. 13 is a sectional view of the flock storing chamber with a shutter thereof being open;

FIG. 14 is an exploded perspective view of a flock exhausting mechanism;

FIG. 15 is a longitudinal-section front view of a main body case bottom portion with a movable type plug being retracted;

FIG. 16 is a sectional view taken along a line X—X in FIG. 15;

FIG. 17 is a longitudinal-section front view of the main body case bottom portion with the movable type plug being projected;

FIG. 18 is a sectional view taken along a line Y—Y in FIG. 17;

FIG. 19 is a front view of a safety switch portion;

FIG. 20 is a longitudinal-section front view of a stand;

FIG. 21 a sectional view taken along a line Z—Z in FIG. 20;

DETAILED DESCRIPTION OF THE INVENTION

Figure 1A:
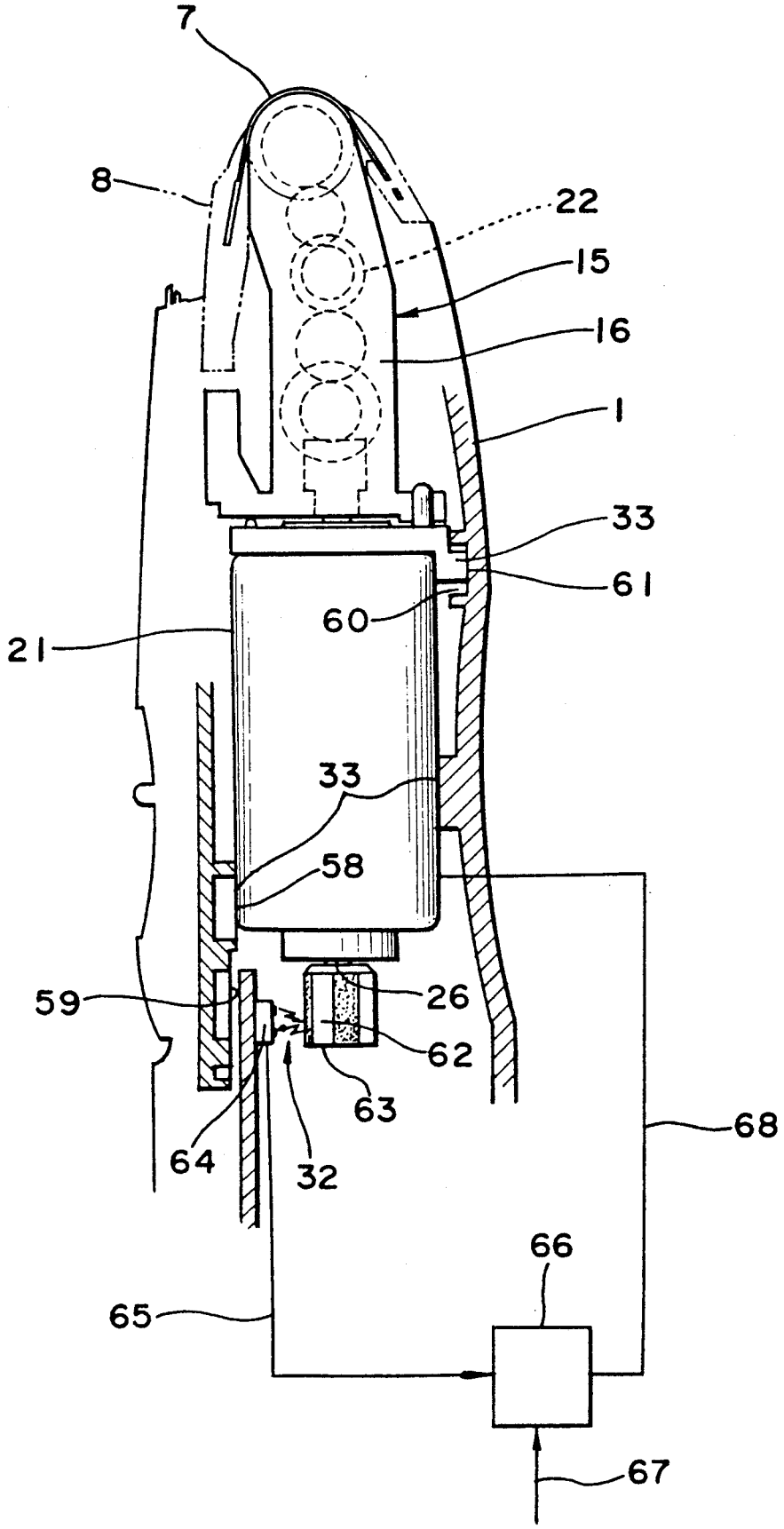
FIG. 1(*a*) is a side view which schematically shows the essential portions of a rotary type electric razor in accordance with the present invention.

Before the description of the present invention proceeds, it is to be noted that like parts are designated by like reference numerals throughout the accompanying drawings.

Referring now to the drawings, there is shown in FIGS. 1 through 21, a rotary type electric razor according to one preferred embodiment of the present invention.

Figure 2:
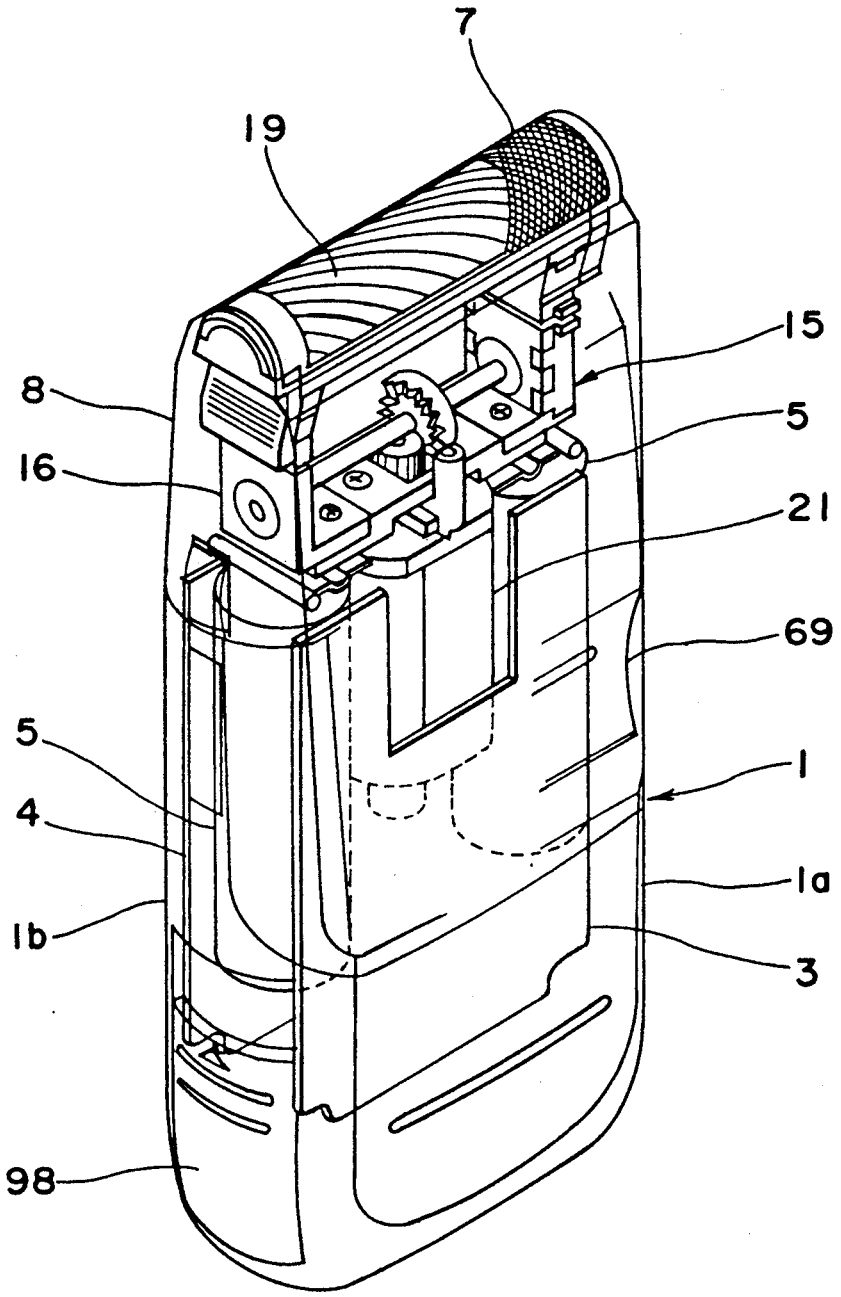
FIG. 2 through FIG. 21 show one embodiment of the present invention.
Figure 3:
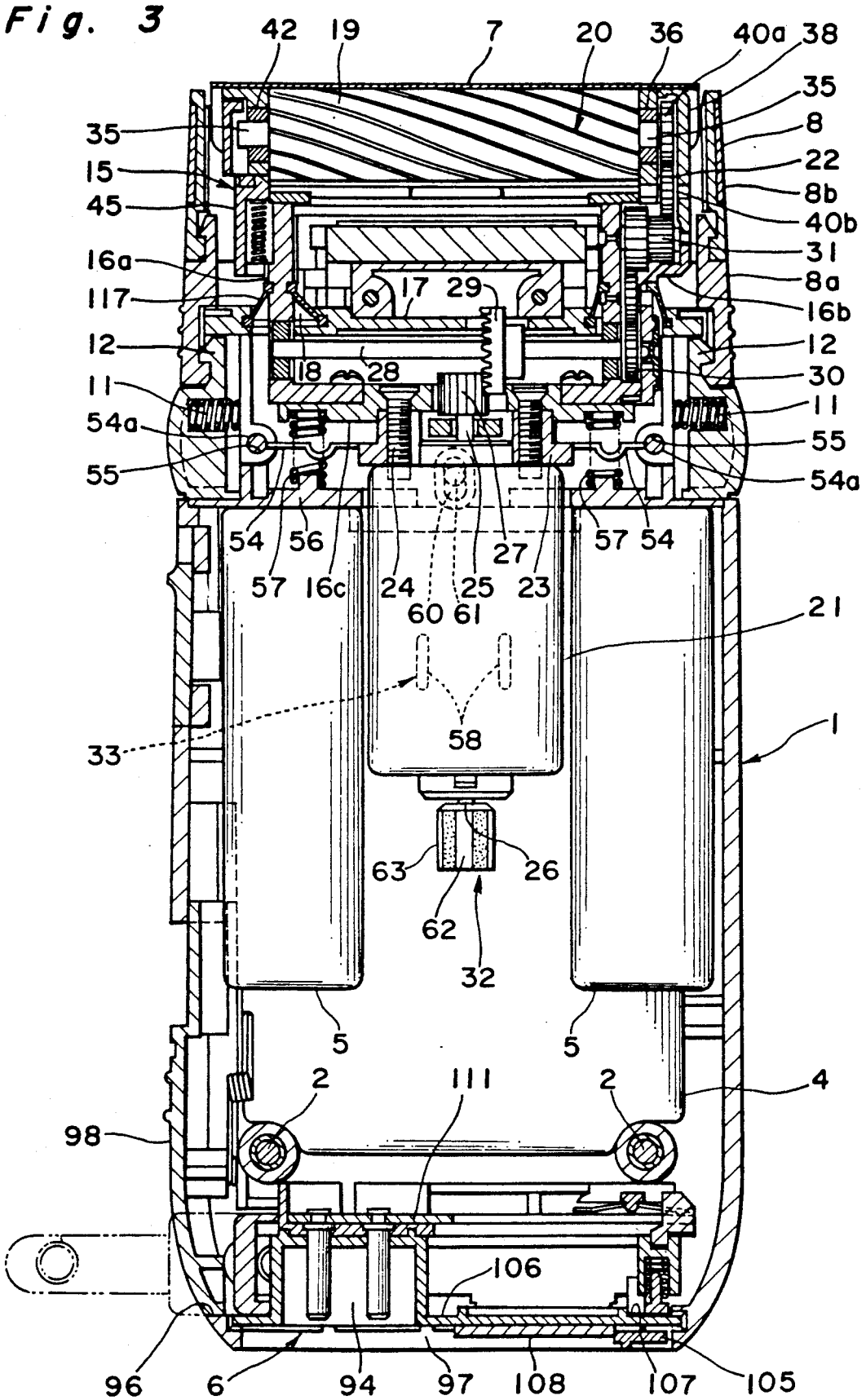
Figure 4:
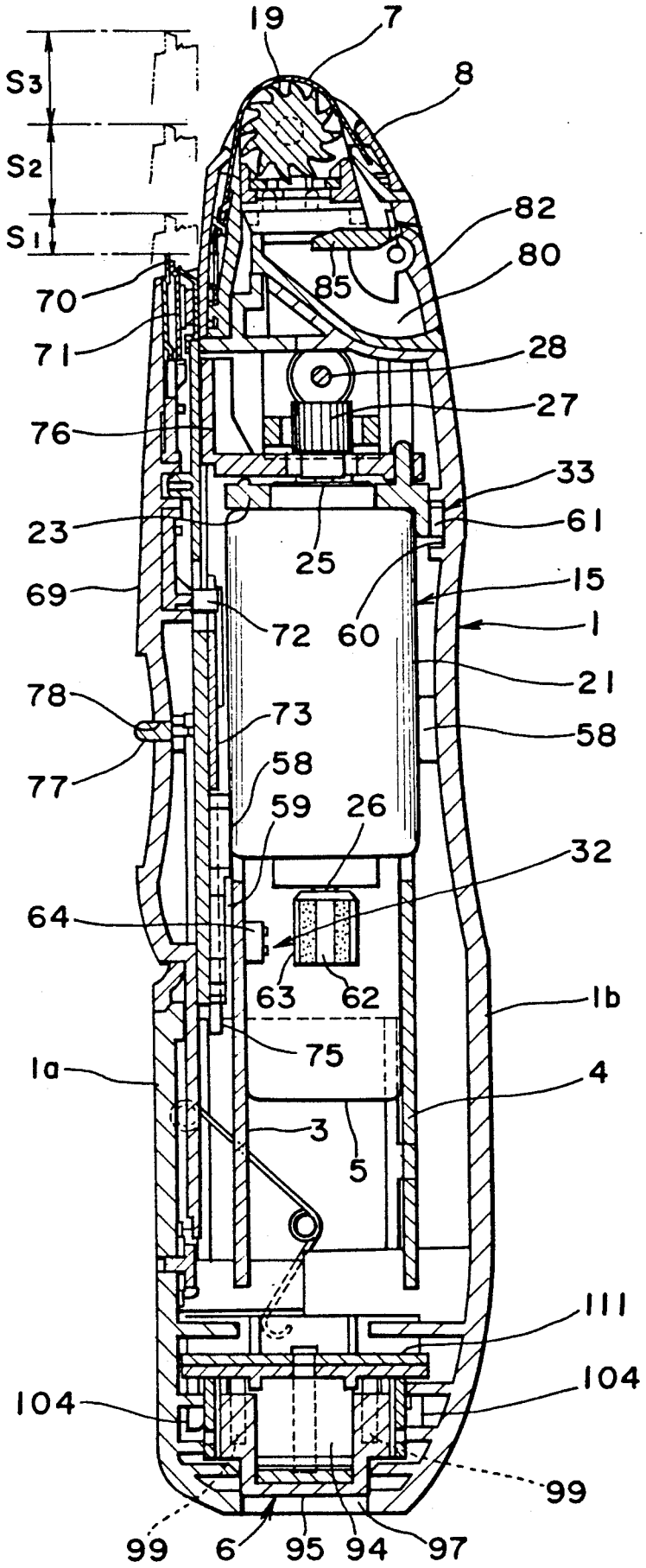

In FIG. 2 through FIG. 4, a main body case 1 has front and back cases 1*a*, 1*b* fastened integrally together with a screw 2 and the like. A pair of front and back circuit base plates 3, 4 are engaged within the lower half portion of the main body case 1 with two rechargeable batteries 5 such as Ni-Cd batteries or the like being arranged between the base plates 3, 4. A plug unit 6 for use in charging the batteries 5 is provided at the bottom of the case 1.

Figure 6:
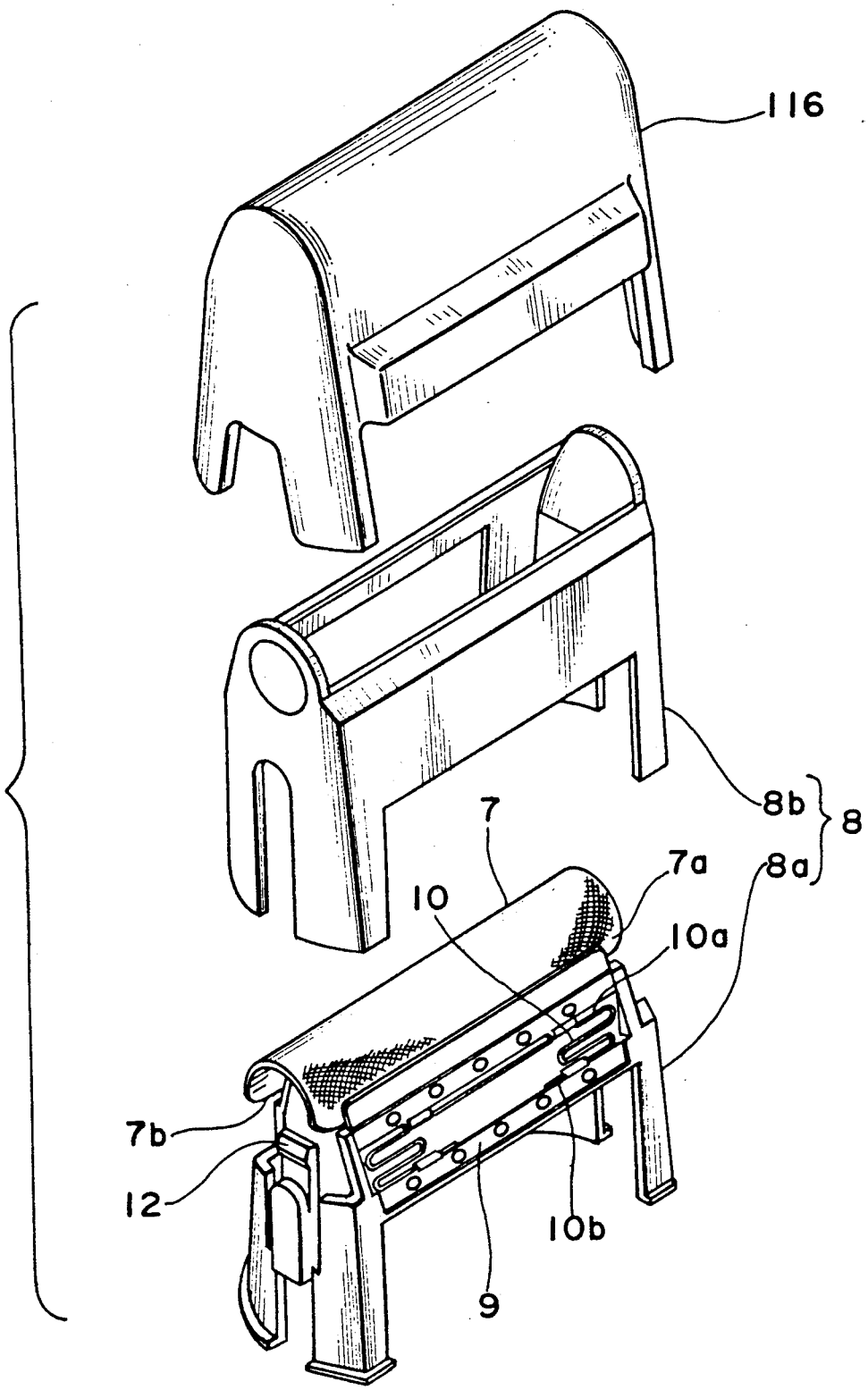
Figure 8:
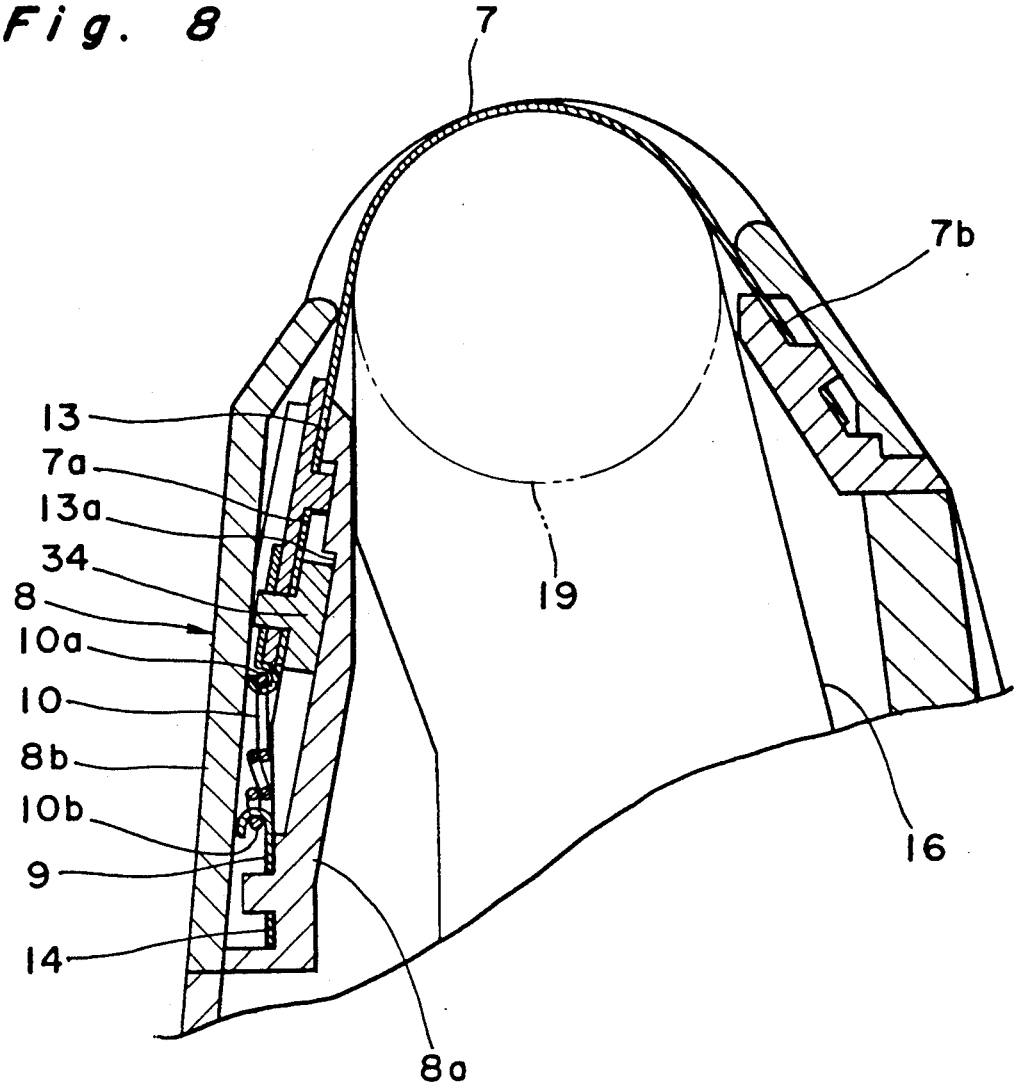

In FIG. 3, FIG. 6 and FIG. 8, a reticulated mesh-type external cutting edge 7 is formed into an arch shape and mounted in a holder 8 and engaged with the top portion of the main body case 1. The external cutting edge holder 8 is composed of an internal holder 8*a* and an external holder 8*b* superposed on the outer side of the internal holder 8*a* such that it can be freely separated therefrom, with the external cutting edge 7 being grasped between the superposed faces of the internal and external holders 8*a*, 8*b*. As shown in FIG. 8, a rear end 7*b* on the stationary side of the external cutting edge 7 is sealingly engaged with the rear wall portion of the internal holder 8*a* and also, a front end 7*a* on the movable side of the external cutting edge 7 is coupled through a zigzag-shaped spring 10 to a support plate 9 mounted on the front wall portion of the internal holder 8*a* so that the external cutting edge 7 is normally pulled towards front end 7*a* on the movable side. The sliding resistance of the external cutting edge 7 with the rotary internal cutting edge 19 is made as small as possible. In order to narrow the front and back widths of the external cutting holder 8, the movable front end 7*a* of the external cutting edge 7 is extended along a downwardly expanding tapered portion 13 mounted against the front face of the internal holder 8*a* so as to make the winding angle small for the rotary internal cutting edge 19 of the external cutting edge 7 as shown in FIG. 8. The supporting plate 9 is fixedly and sealingly attached to the straight portion 14 formed in the vertical shape downwardly of the tapered portion 13 continuously with the front face of the internal holder 8*a*. Also, the upper and lower ends 10*a*, 10*b* of the zigzag-shaped spring 10 are pivotably, respectively, with respect to the front end 7*a* on the movable side of the external cutting edge 7 and the support edge 9.

Therefore, when the external cutting edge 7 is pressed against the skin, the external cutting edge 7 is pressed downwardly and deforms the spring 10 to effect downward movement thereof. When the external cutting edge 7 is separated from the skin, the external cutting edge 7 moves upwardly and is restored by the expansion restoring force of the spring 10. A movable piece 34 which is integrally connected with the movable front end 7a of the external cutting edge 7, the front face of the internal holder 8a is caused to slide against and along the guide groove 13a formed in parallel to the tapered portion 13, so that it is guided straight and smoothly in the vertical direction. Also, since the spring 10 pivots at its upper and lower ends 10a, 10b, respectively, with respect to the front end 7a on the movable side of the external cutting edge 7 and the support plate 9, during vertical motion of the external cutting edge 7. Thus, the resulting angular difference between the tapered portion 13 on the front face of the internal holder 8a and the straight portion 14 is accommodated, and the front end 7a on the movable side of the external edge 7 is properly deformed so as to allow for smooth vertical motion of the tapered portion 13.

The right and left wall portions of the internal holder 8a are engaged and retained by a pair of engaging pawls 12 each of which has a knob attached to it. Each of the knobs is movable between a fully exposed position and a position in which it is pressed inwardly against the bias of one of the respective springs 11 at the top ends on the right and left sides of the main body case 1. Therefore, in FIG. 3, when the engagement pawls 12 are depressed against the forces of the springs 11, the external cutting edge 7 together with the external cutting edge holder 8 may be removed from the main body case 1. In FIG. 6, reference number 116 shows a protective cap which is put on the external cutting edge holder 8 during non-use.

Figure 5:
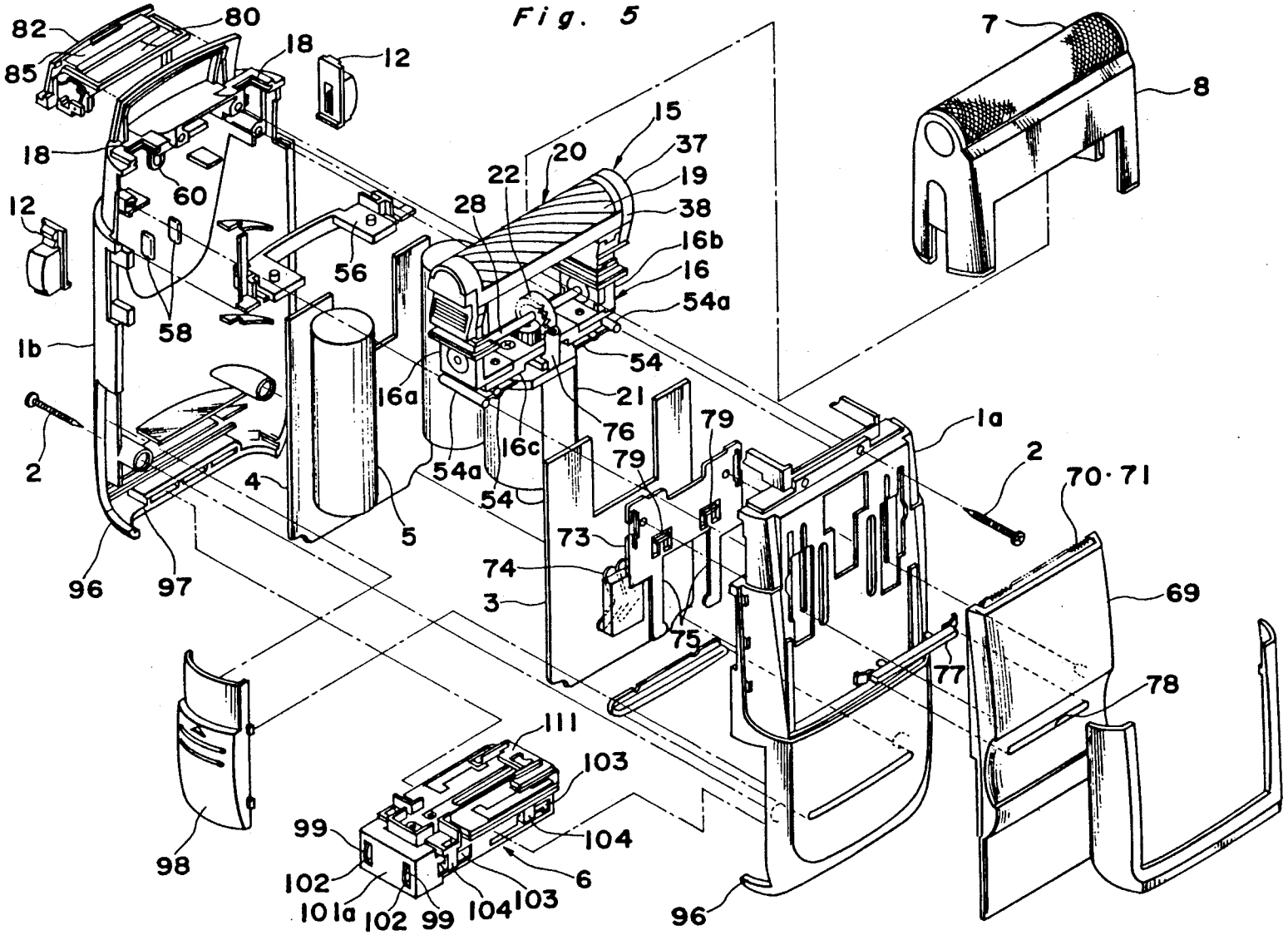

An internal cutting edge driving unit 15 is engaged with the main body case 1. The internal cutting edge drive unit 15 has an internal cutting edge driving chassis 16, an internal cutting edge unit 20, a motor 21 and a drive transmitting means 22, as shown in FIG. 5.

Figure 7:
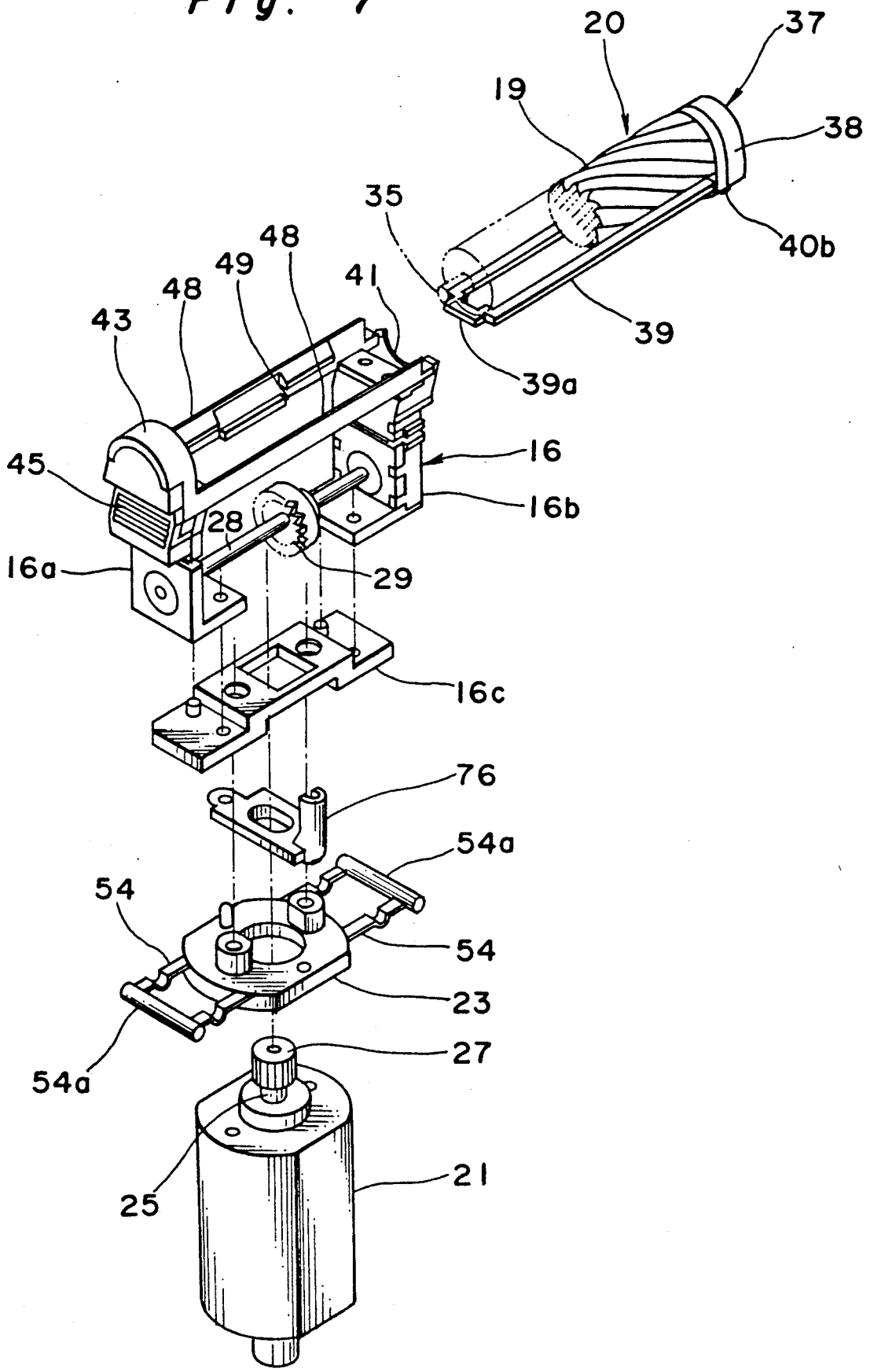

As shown in FIG. 3 and FIG. 7, the internal cutting edge driving chassis 16 is formed entirely in a U-character shape as seen from the front, has right and left chassis 16a, 16b and a bottom chassis 16c, and is engaged in the main body case 1 so that the respective upper top ends of the right and left chassis 16a, 16b may be projected upwardly from the slots 18 of the upper wall 17 of the main body case 1. The clearance between the right and left chassis 16a, 16b and the respective slots 18 is filled up with a flock penetration preventing rubber 117.

The internal cutting edge unit 20 has a rotary cutting edge 19 having a spiral cutting edge, and is detachably supported laterally between the upper end portions of the right and left chassis 16a, 16b to be projected from the upper wall 17 of the main body case 1 so that the rotary internal cutting edge 19 may be rotated in slidable contact with respect to the internal face of the external cutting edge 7.

A motor 21 and a gear transmission type of drive transmitting means 22 for transmitting the rotation of the motor 21 into the rotary internal cutting edge 19 are mounted on the internal cutting edge driving chassis 16. A motor holder 23 is superposed on the bottom chassis 16c of the internal cutting edge drive chassis 16 and is integrally connected with a screw. The motor 21 is a dual-shaft type of motor which has output shafts 25, 26 above and below the motor holder 23 and is retained on the motor holder 23 in a vertical posture with a screw 24.

As shown in FIG. 3, the drive transmitting means 22 has an output gear 27 secured to the upper portion of the output shaft 25 which projects upwardly of the motor holder 23 and the bottom chassis 16c from the upper end of the motor 21, has a power shaft 28 rotatably supported between the right and left chassis 16a, 16b above the bottom chassis 16c, has a gear 29 which is secured onto the axial central portion of the power shaft 28 and interlocked orthogonally with the output gear 27, and has a gear 30 which is secured onto the right end of the power shaft 28 and interlocked with a multistage gear 31 accommodate within the right chassis 16b.

In FIG. 3 and FIG. 7, the internal cutting edge unit 20 which is detachably engaged between the upper end portions of the right and left chassis 16a, 16b comprises the cutting edge 19 which is a cylinder type of rotary internal cutting edge, a shaft 35 projected from both the right and left ends of the rotary internal cutting edge 19, and an internal cutting edge holder 37 for rotatably supporting the shaft 35 on the right end side through a bearing 36 integrally engaged with the holder 37. The internal cutting edge holder 37 has an open-bottomed housing 38 for accommodating the bearing 36, a coupling frame 39 projected horizontally towards the left side from the lower portion of the housing 38. A gear 40a is secured onto the shaft 35, and a gear 40b to be interlocked with it is mounted thereabove within the housing 38, with the lower portion of the periphery of gear 40b facing the open bottom of the housing 38 so that it may be detachably engaged with the uppermost stage gear of the multistage gear 31 of the driving transmitting means 22.

Figure 9:
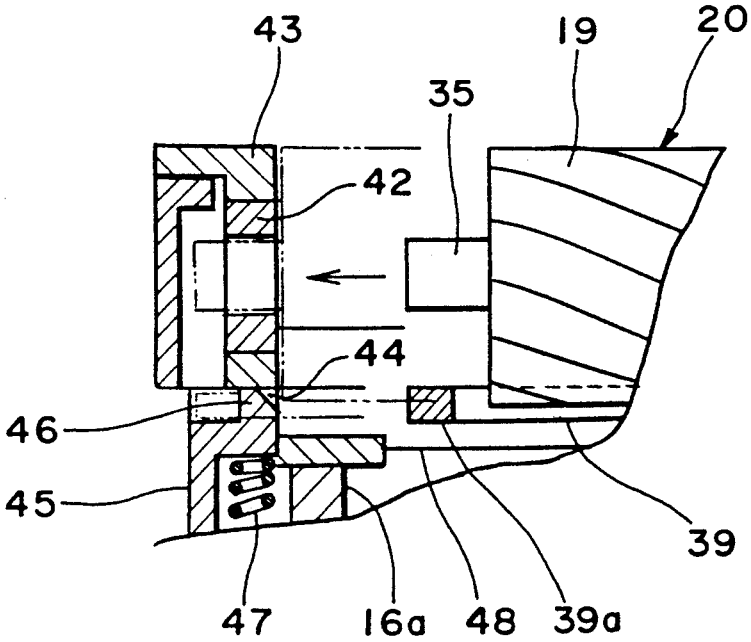

In FIG. 7 and FIG. 9, in the detachable construction with respect to the upper end of the internal cutting edge drive chassis 16 of the internal cutting edge unit 20, a housing receiving portion 41 for receiving and supporting the housing 38 of the internal cutting edge unit 20 is provided on the top end side of the right chassis 16b. A housing 43 for accommodating a bearing 42 which detachably supports the shaft 35 on the left side of the rotary internal cutting edge 19 is integrally extended on the top end side of the left chassis 16a such that it is higher than the housing receiving portion 41 on the right side. Also, as shown in FIG. 9, a coupling hole 44, into which the tip end 39a of the coupling frame 39 of the internal cutting edge holder 37 is inserted and supported, formed in the lower portion of the housing 43 of the left chassis 16a to provide for easy insertion and removal of the frame 39. Further, a locking means is provided on the left chassis 16a so that the tip end 39a of the coupling frame 39 will not slip out of the coupling hold 44. The locking means includes an internal cutting edge disengaging button 45 on the outer side of the left chassis 16a, and a locking pawl 46 which is detachably connectible with respect to the internal side of the tip end 39a of the coupling frame 39 and is integrally projected from the internal face of the internal cutting edge disengaging button 45. The internal cutting edge disengaging button 45 is normally upwardly urged by the spring 47 so as to retain the engagement condition wherein the locking pawl 46 is engaged with the tip end 39a of the coupling frame 39.

As shown in FIG. 7, a guide frame 48 is integrally mounted horizontally between the upper end portions of the right and left chassis 16a, 16b. A guide groove 49 is provided, at a height which will allow the coupling frame to be guided into the coupling hole 44, on front and rear sides of the internal face of the guide frame 48. The tip end 39a of the coupling frame 39 is inserted from the right end side into the guide groove 49 so as to slidably engage the whole of the internal cutting edge unit 20 horizontally in the left direction so that the tip end 39*a* of the coupling frame 39 can be inserted into the coupling hole 44.

In order to engage the internal cutting edge unit 20 between the upper end portions of the left and right chassis 16*a*, 16*b*, the coupling frame 39 is slid into the guide groove 49 towards the left chassis 16*a* from the right chassis 16*b* so as to insert the shaft 35 on the left side into the bearing 42 as shown in two-dot chain line in FIG. 9, and also, to insert the tip end 39*a* of the coupling frame 39 into the coupling hole 44. In order to insert the tip end 39*a* of the coupling frame 39 into the coupling hole 44, the tip end 39*a* comes into contact with the taper of the locking pawl 46 so as to push down the butting 45 against the elasticity of the spring 47. When the tip end 39*a* passes the locking pawl 46, the button 45 automatically moves upwardly due to the spring 47 to engage the locking pawl 46 within the coupling frame 39 and the locking operation is complete. As shown in FIG. 3, the housing 38 of the internal cutting edge unit 20 conforms to the housing receiving portion 41 of the right chassis 16*b* in such a manner as to obtain a condition where the gear 40*b* within the housing 38 is adapted to be interlocked with the gear 31 of the drive transmitting means 22. When the internal cutting edge unit 20 is assembled, the coupling frame 39 is inserted and supported within the coupling hole 44, and also, the locking pawl 46 is locked into a slip preventing condition so that the vertical, longitudinal, right, and left movements of the internal cutting edge unit 20 are regulated.

During assembly of the internal cutting edge unit 20, since the internal cutting edge unit 20 is integrally provided with an internal cutting edge holder 37, and especially the housing 38 portion thereof, may be grasped with fingers so that it may be safely mounted without directly touching the spiral cutting edge of the rotary internal cutting edge 19. Easy assembly may be effected by sliding the coupling frame 39 onto the guide frame 48.

Figure 10A:
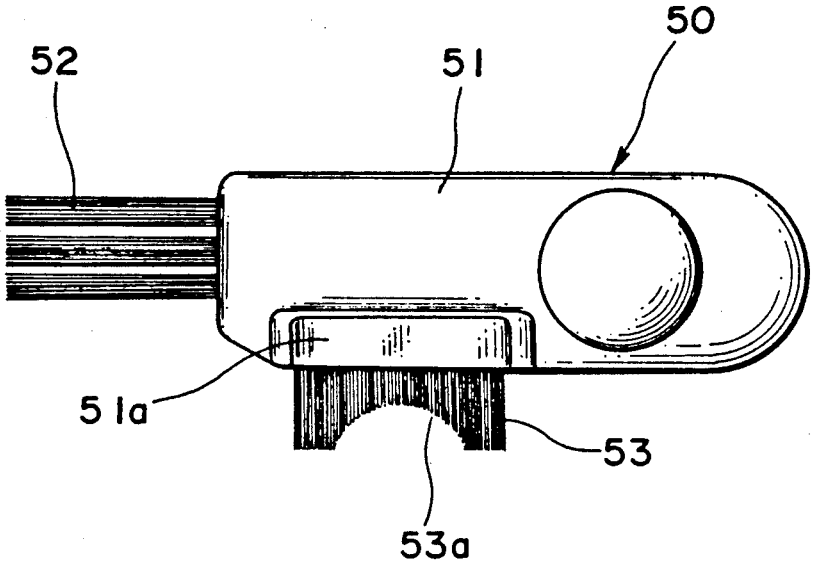
Figure 10B:
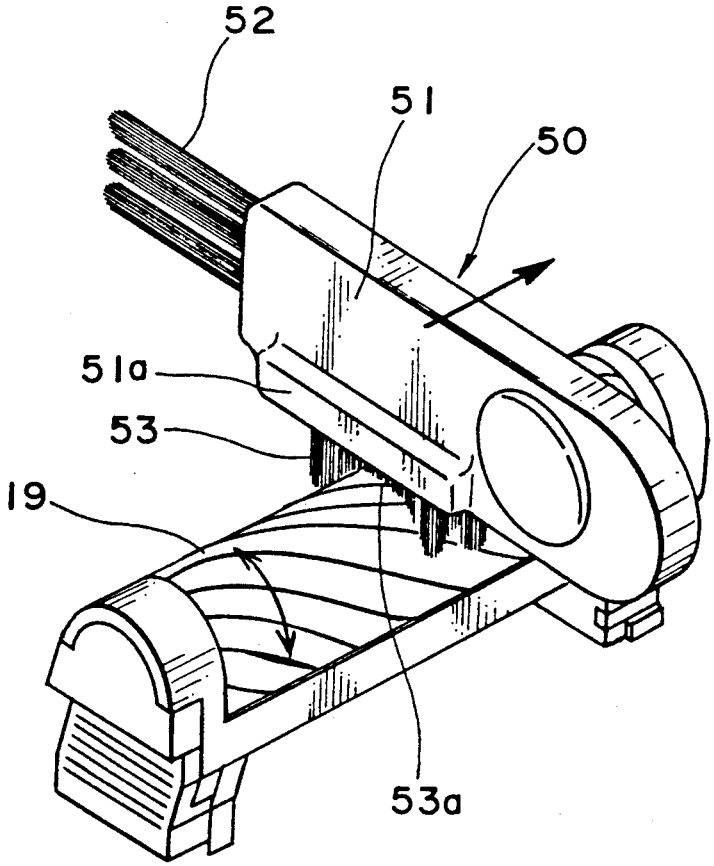

A cleaning operation may be performed with the rotary internal cutting edge 19 engaged on the internal cutting edge driving chassis 16. As shown in FIG. 10 (*a*), brush bar 52 of a common stiffness and brush hair 53, which is stiffer than the brush hair 52, are provided on a brush handle 51 to form a brush 50 for cleaning the razor. The hair 53 has a circular-arc concave portion 53*a* shaped to conform to the circumference of the rotary internal cutting edge 19. As shown in FIG. 10(*b*), to clean the rotary internal cutting edge 19, the circular-arc concave portion 53*a* of the harder brush hair 53 is slid along the circumferential portion of the rotary internal cutting edge 19 from one end to the other. Since the rotary internal cutting edge 19 includes the spiral-shaped edge groove continuing from one axial end of the rotary internal cutting edge 19 to the other, the rotary internal cutting edge 19 is forced to rotate and the flocks are raked off of the cutting edge 19. A projected portion 51*a* is provided on the handle 51 of the cleaning brush 50 so as to be positioned above the harder brush 53 and prevent a finger from slipping from the handle 51. Therefore, during the cleaning operation, the rotary internal cutting edge, in which the harder brush 53 is slid along edge 19 with the spiral-shaped cutting edge, the fingers are safe since the cleaning operation may be effected without injuring the fingers with the spiral-shaped cutting edge, because the fingers on the handle 51 are prevented from sliding towards the spiral-shaped cutting edge due to the slip-preventing projected portion 51*a*.

To clean the rotary internal cutting edge 19 with it disengaged or to replace the cutting edge with a new one, the internal cutting edge disengaging button 45 is pressed downwardly against the elastic force of the spring 47 after the external cutting edge 7 together with the holder 8 has been disengaged from the top portion of the main body case 1, and the locking pawl 46 is downwardly drawn out from the internal side of the tip end 39*a* of the coupling frame 39. The whole internal cutting edge unit 20 is then slid in the right direction, so that the internal cutting edge unit 20 may be disengaged from the internal cutting edge driving chassis 16.

In FIG. 3 and FIG. 7, the internal cutting edge driving chassis 16 includes floating support means which includes front and back supporting arms 54, which are elastically deformable only in the vertical direction from the right and left ends of the motor holder 23 which is preferably formed of plastic, and which are integrally projected horizontally in the right and left directions, respectively. A tip end 54*a* of each support arm 54 is fixedly engaged with a concave portion 55 provided in the internal wall of the main body case 1, so that the whole internal cutting edge driving unit 15 is supported for free vertical motion through the elastic deformation of the right and left supporting arms 54. Compression springs 57 are interposed between the bottom side of the internal cutting edge driving chassis 16 and a pair of spring receivers 56 secured on the side of the main body case 1. The whole internal cutting edge driving unit 15 is adapted to be normally urged upwardly toward the external cutting edge by the springs 57 so that the circumferential top portion of the rotary internal cutting edge 19 is adapted to normally come into close contact with the internal face of the external cutting edge 7.

As shown in FIG. 3 and FIG. 4, a vertical motion guide means 33 for limiting movement in the longitudinal and right and left directions of the internal cutting edge driving unit 15 is provided between the motor 21 and the internal face of the main body case 1. The vertical motion guide means 33 comprises front and back position regulating ribs 58 integrally projected from each internal face of the front and back cases 1*a*, 1*b*, respectively, and is adapted to guide the motor 21 between the front and back position regulating ribs 58 to limit the movement of the whole internal cutting edge driving unit 15 in the forward and rear directions. Also, a longitudinal, elliptic concave portion 60 is formed on the internal face of the back case 1*b*, and a pin 61 is projected from the motor holder 23. Regulation of movement in the right and left directions of the internal cutting edge driving unit 15 is also ensured by sliding engagement of the pin 61 within the concave portion 60 in only the vertical direction.

Figure 1B:
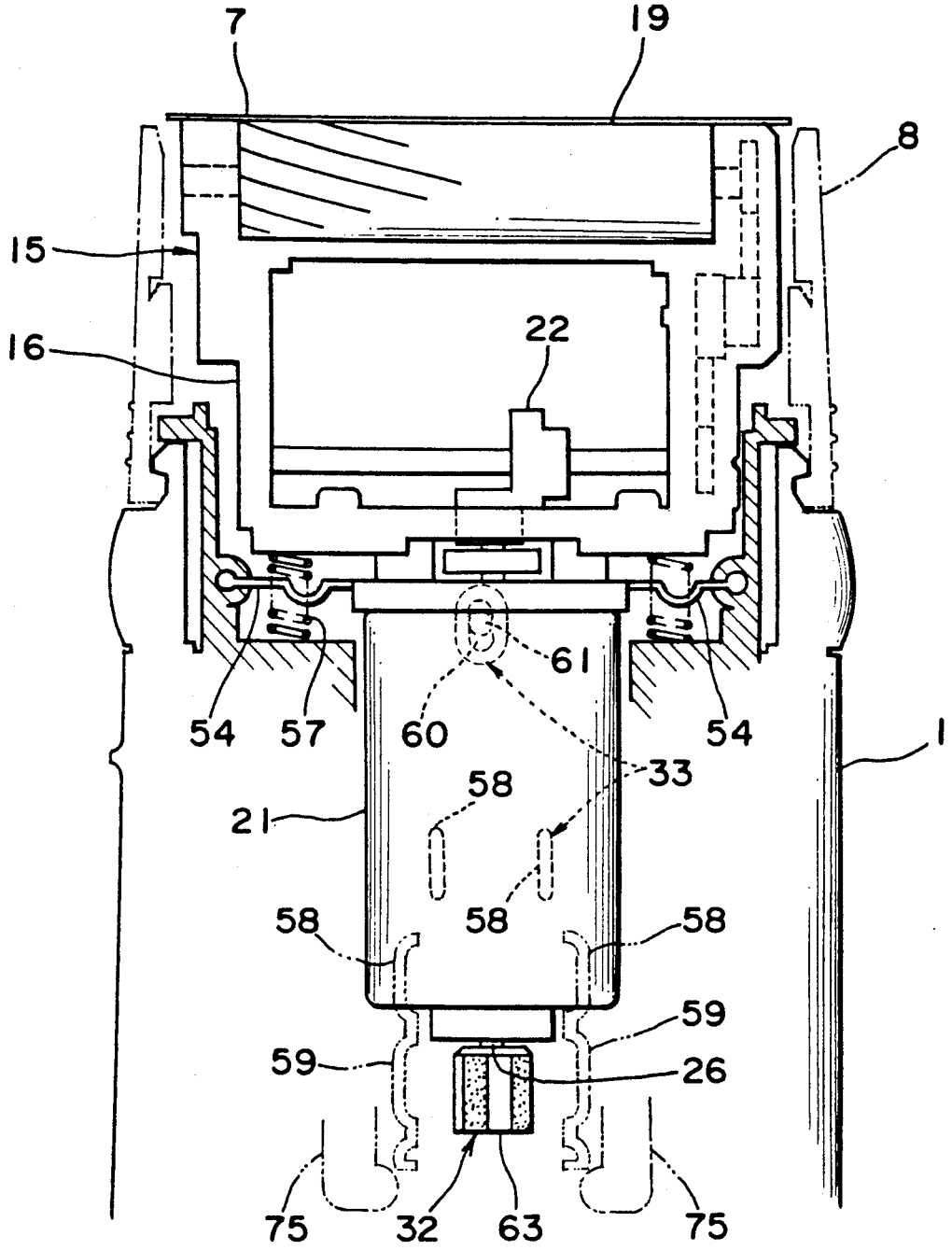

As shown in FIG. 1(*a*) and FIG. 4, within the main body case 1, a means 32 is provided adjacent the lower portion of the motor 21 to detect the revolution number of the lower output shaft 26 of the motor 21. The revolution number detecting means 32 has a roll-shaped rotary member 63 to be detected. Reflection portions 62 are attached about the rotary member 63 at a constant pitch on the peripheral surface, and the rotary member 63 is engaged with the lower output shaft 26 of the motor 21. A photosensor 64 with light receiving and emitting elements is mounted in opposition to the rotary member 63 and the light emitting element of the photosensor 64 emits light toward the peripheral face of the rotary member 63 and the light receiving element of the photosensor 64 receives light reflected from the reflection portions 62 of the rotary member 63. The detecting means 32 then outputs a signal 65 based on the pulse rate of reflected light which is proportional to the revolution number of motor 21. The detection signal 65 output from the revolution number detecting means 32 is input to a revolution-number controlling circuit 66 of the motor 21. The controlling circuit 66 compares the value of the detection signal 65 output from the photosensor 64 with the value of a reference signal 67 and applies a drive voltage 68 to the motor 21 corresponding to the difference between the values so as to maintain a constant motor revolution speed.

The detection signal 65 output from the revolution number detecting means 32 may also be used when the need for charging of the batteries 5 is to be indicated by a display lamp when the revolution speed of the motor 21 has decreased due to the weakness of the batteries 5 in the rechargeable electric razor.

Since movement the internal cutting edge driving unit 15 is limited in the longitudinal and right and left directions by the vertical motion guide means 33 as described hereinabove, the distance between the photosensor 64 and the rotary member 63, as well as the angle between the central axis of the rotary member 63 and the photosensor 64, are maintained constant. Therefore, the light reflected from the rotary member 63 is reliably received and detected by the light receiving element of the photosensor 64, so that detection errors do not occur.

As shown in FIG. 4, a switch case 69 is mounted for sliding in the vertical direction along the external face of the front case 1*a*. A stationary comb cutting edge 70 and a movable comb cutting edge 71 for use in shaving sideburns and the like are provided within the upper portion of the switch case 69 so that each cutting edge may be projected upwardly. Also provided is a driving piece 72 for receiving the motor output and transmitting it to the movable comb cutting edge 71. The switch case 69 is integrally connected with a moderation plate 73 (see FIG. 5) arranged on the inner face side of the front case 1*a*. The moderation plate 73 has a switch leaf spring 74 which is removably coupled to the switch terminal on the circuit base plate 3 through vertical sliding of the switch case 69 and a moderation arm 75 which is fittingly engageable with the moderation projection 59 projected from the internal face of the front case 1*a*. As shown in FIG. 1(*b*), the moderation projection 59 forms a circular-arc shape, as seen from the front face, and with the front and back motion regulating ribs 58 projected from the internal face of the front case 1*a*, it is provided at three positions in the vertical direction so as to be constructed for use as the front and back motion regulating ribs 58 and the moderation projection 59. The moderation projection 59 may be provided separately from the front and back motion regulating ribs 58.

By the gradual stepwise engagement of the moderation arm 75 with the moderation projection 59, the switch case 69 can be positioned and retained respectively in a lower waiting position (switch off position) shown in solid lines in FIG. 4, a motor starting position (switch on position) located one step above the waiting position, and a first upper projection use position located one step above the starting position. In the first upper projection use position, the driving piece 72 for use in shaving sideburns or the like is engaged with a sideburn shaver driving arm 76 mounted on the upper output shaft 25 of the motor 21 to transmit the driving force to the moveable comb cutting edge 71. The movable comb cutting edge 71, the stationary comb cutting edge 70, the rotary internal cutting edge 19 and the external cutting edge 7 are combined for use. A second upper projection use position used only for the sideburn shaving edge (movable comb cutting edge 71, stationary comb cutting edge 70) is provided one step above the first upper projection use position. As shown in FIG. 4, reference character S1 shows the distance by which the switch case 69 is moved when raised. Reference character S2 shows the distance from the motor starting position into the first upper projection use position, and reference projection use position, and reference character S3 shows the distance from the first upper character S3 shows the distance from the first upper projection use position into the second upper projection use position.

In FIG. 4 and FIG. 5, a locking button 77 for retaining the switch case 69 in the lower waiting position and preventing unexpected upward motion thereof is projected from the hole 78 of the switch case 69. The locking pawl 79 projected from the moderation plate 73 is engaged with the engagement portion (not shown) of the internal face of the front case 1*a* as shown in FIG. 5 to retain the switch case 69 in the lower waiting position. When the locking button 77 is depressed, the locking pawl 79 is disengaged from the engagement portion of the internal face of the front case 1*a* to make it possible to slide the switch case 69 upwardly.

Figure 11:
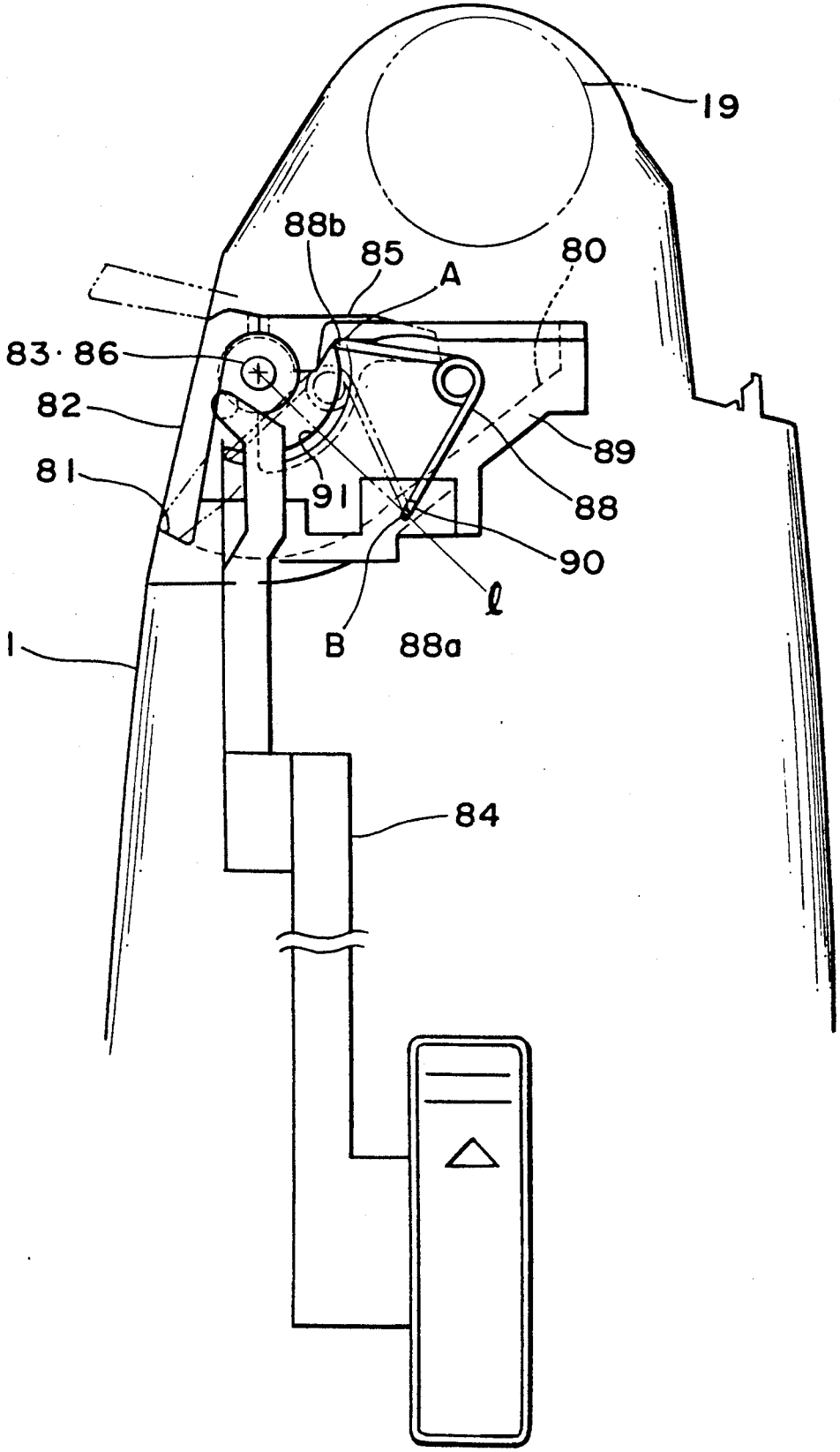
Figure 12:
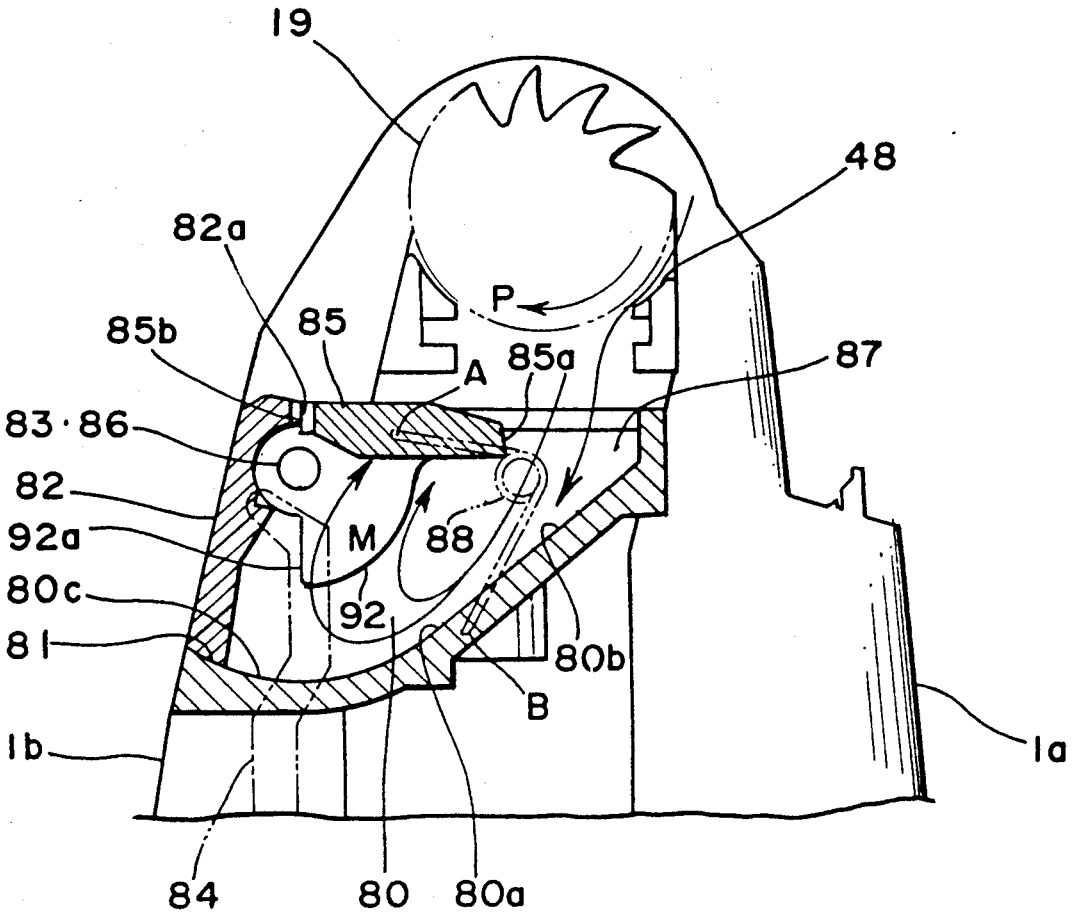
Figure 13:
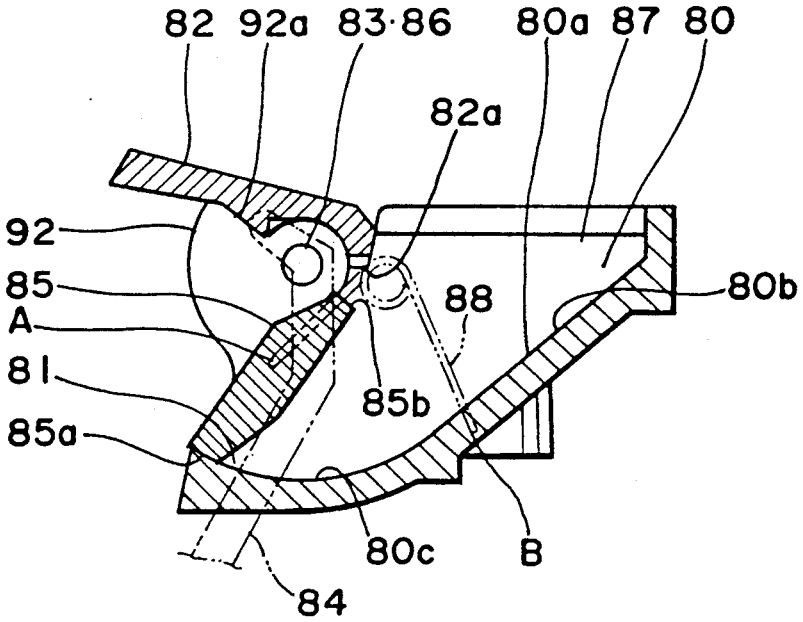
Figure 14:
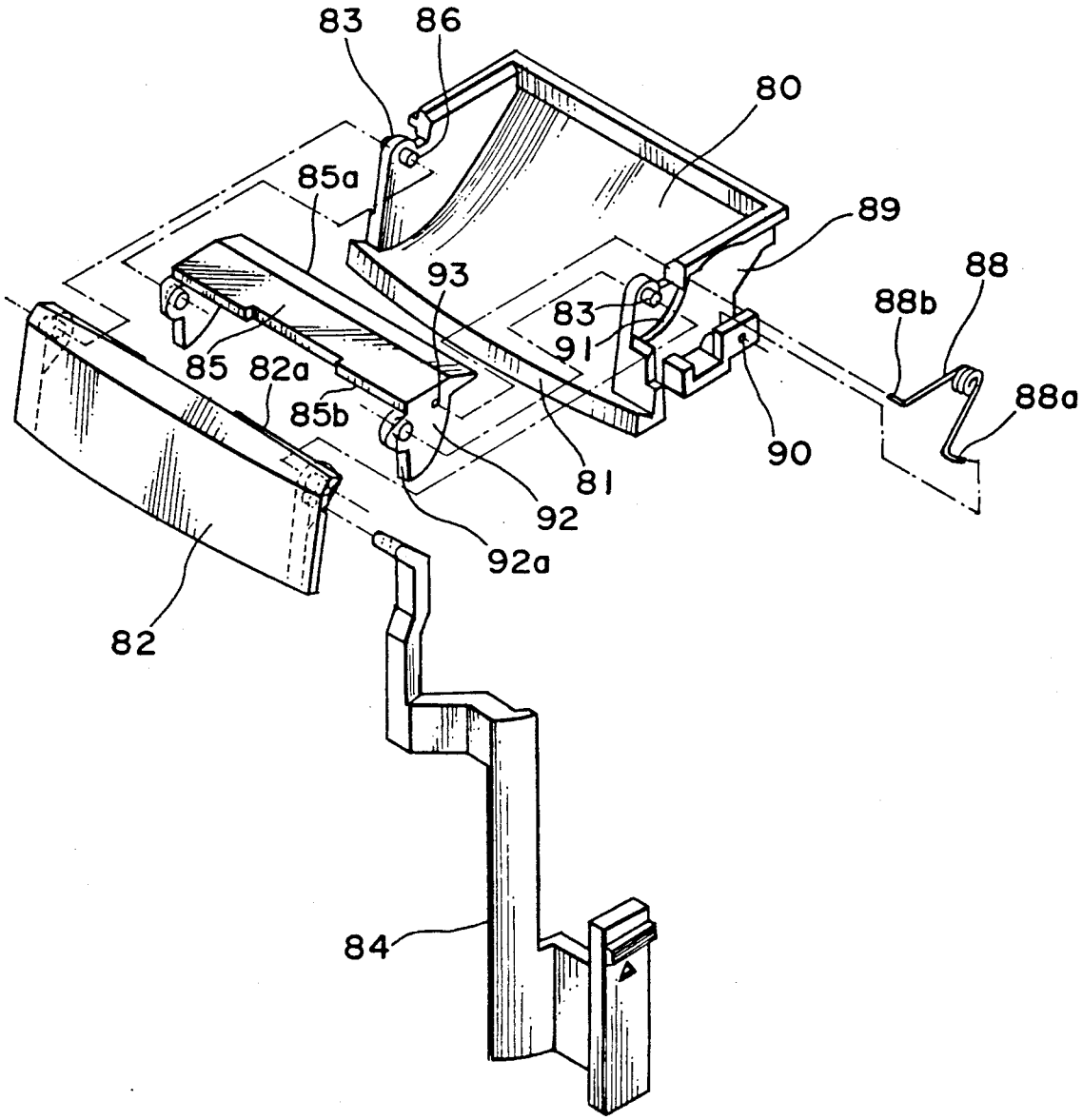

As shown in FIG. 4 and FIG. 11 through FIG. 14, a flock storing chamber 80 for storing the flock which fall from the internal cutting edge 19 is formed downwardly of the rotary internal cutting edge 19 of the main body case 1. As shown in FIG. 12, the flock storing chamber 80 is formed as a downwardly inclined passage composed of a straight portion 80*b* with a downwardly inclined bottom face 80*a*, a curved portion 80*c* formed continuously with the straight portion 80*b*, and an exhaust opening 81 formed at the lower end of the curved portion 80*c* so that the exhaust opening 81 confronts the upper external side of the back case 1*b*. In the exhaust opening 81 of the flock storing chamber 80, a shutter 82 is rotatably pivoted by approximately 90 degrees around the shaft 83 between a closed position (see FIG. 12) for closing the exhaust opening 81 and an opened position (see FIG. 13) for emptying the flock storing chamber 80. The shutter 82 is operatively coupled to an opening/closing lever 84 which is adapted to slide a given distance in the vertical direction on the side face of the main body case 1, to pivot the shutter 82 between its opened and closed positions about the shaft 83. Within the flock storing chamber 80, a raking blade 85 is mounted to pivot by approximately 124 degrees around a shaft 86 between a waiting position (see FIG. 12) and a terminal position (see FIG. 13). It is to be noted that the shaft 83 and the shaft 86 are coaxial. As shown in FIG. 12, in the waiting position of the raking blade 85, the entrance 87 for flock inflow is formed between the tip end 85*a* of the blade 85 and the straight line portion 80*b* of the internal bottom face 80*a* of the flock storing chamber 80 such that it is along a tangent of the circumference of the internal cutting edge 19. When the raking blade 85 is pivoted toward the exhaust opening from its waiting position, the tip end 85*a* gradually approaches the curved portion 80*b* of the internal bottom face 80*a*. When the tip end 85*a* is pivoted along the curved portion 80*b* to the terminal position, the flock on the internal bottom face 80*a* is raked out of the exhaust opening 81. In the portion of its pivotal range from the waiting position towards the internal bottom face 80*a* of the tip end 85*a*, the raking blade 85 is caused to pivot with the opening operation of the shutter 82, so that the pivoting operation toward the exhaust opening direction after that is automatically effected by the restoring force of the spring 88. Thus, as shown in FIG. 11 and FIG. 14, the torsion coil spring 88 is entrained between the raking blade 85 and the main body case 1. The spring 88 has its one end 88*a* engaged in a hole 90 provided in the side wall 89 of the flock storing chamber 80 in its normal condition. Also, the other end 88*b* is extended through an arc-shaped groove 91 around the shaft 83 in the side wall 89 and is engaged in a hole 93 provided in a central position between the hole for shaft 86 in the side wall 92 of the raking blade 85 and the tip end 85*a*.

As shown in FIG. 12, in a condition where the shutter 82 closes the exhaust opening 81 and the raking blade 85 is in a waiting position, the spring 88 pivotally urges the raking blade 85 upwardly and the base end 85*b* of the raking blade 85 comes into pressure contact with the top end 82 of the shutter 82 so as to retain the shutter 82 in a closed condition. In this condition where the shutter 82 is closed and the raking blade 85 is waiting in this manner, the flock which falls from the rotary internal cutting edge 19 flows into the flock storing chamber 80 through the entrance 87 and is stored. As shown in FIG. 12, a gap is formed between the circumference of the rotary internal cutting edge 19, which is to be rotated in a direction P, and the front side of guide frame 48, and the gap is gradually narrowed from its upper to lower portions along the rotating direction P, so that the flow speed of the flocks within the gap is increased so that they flow smoothly into the entrance 87. The raking blade 85 in the waiting condition functions to prevent the flocks from being scattered externally from the entrance 87 when the flocks are scattered by the air stream (as shown by arrow M) within the flock storing chamber 80 caused by the rotating operation of the rotary internal cutting edge 19.

In order to exhaust the flocks placed within the flock storing chamber 80, the opening/closing lever 84 is slid upwardly to pivot the shutter 82 around the shaft 83. Initially, the raking blade 85 is pressed against by the top end 82*a* of the shutter 82 as it is pivoted toward the raking terminal position. At a position where the distance between the movable point A and the stationary point B is at its smallest, the movable point A (at which the end 88*b* of spring 88 is coupled to the raking blade 85) of the spring 88 has arrived at a dead center point on a line segment l (see FIG. 11) connecting the center of shaft 86 with the stationary point B (at which the other end 88*a* of the spring 88 is coupled to the side wall 92). At this position, the spring 88 is coiled to its greatest extent. Beyond the dead center point, the spring 88 begins uncoiling and causes the base end 85*b* of the raking blade 85 to suddenly separate from the top end 82*a* of the shutter 82 due to the restoring force of the spring. Thereafter, the spring causes the raking blade 85 to quickly pivot to its terminal position. Thus, the flocks within the flock storing chamber 80 are raked externally from the exhaust opening 81 by the tip end 85*a* through the quick pivoting of the raking blade 85 and are ideally exhausted without the flocks becoming attached about the periphery of the exhaust opening 81, as the fingers grasp the main body case 1. When the raking operation of such flocks is effected with the exhaust opening 81 directed at, for example, a trash can, the flocks are not scattered around.

The raking blade 85 brings the end 92*a* of the side wall 92 into contact with the internal face of the shutter 82 as the raking blade moves toward its terminal position as shown in FIG. 13. Thus, when the shutter 82 is pivoted into its closed position upon lowering of the opening/closing lever 84, the raking blade 85 is pressed against by the internal face of the shutter 82 so as to pivot the shutter 82 toward its waiting position. When the spring 88 moves beyond the dead center point of the segment l, the raking blade 85 is automatically returned to its waiting position by the the spring restoring force.

As shown in FIG. 3, FIG. 4, FIG. 15 and FIG. 16, a plug unit 6 for use in charging the batteries 5 is mounted within the bottom side of the main body case 1. The plug unit 6 comprises a plug base plate 111 fixedly inserted between the front and back cases 1*a*, 1*b* as shown in FIG. 4, a stationary type socket 94 which is secured to the lower face of the plug base plate 11 so as to be fed through a power supply cord, and a movable type plug 95, for use in charging, which is mounted for sliding movement in the right and left directions with the lower face of the base plate 111, such that it can be inserted into the wall plug socket. The stationary type socket 94 and the movable type plug may be selectively used.

A plug opening 96 opens through a face of the bottom portion of the front and back cases 1*a*, 1*b* and an operation groove 97 opens through the bottom of the case. The plug opening 96 may be opened and closed with a plug cover 98 which is mounted for vertical slidable movement above the plug opening 96 on a side of the front and back cases 1*a*, 1*b*. A corner at the side of the plug opening 96 of the front and back cases 1*a* and 1*b* is curved along the vertical and longitudinal directions. Also, the lower end portion of the plug cover 98 is curved so as to correspond to the shape of the corner of the front and back cases 1*a*, 1*b* (see FIG. 15 and FIG. 16). Therefore, tight grasping of the main body case 1, will not hurt the hand of the user.

Figure 15:
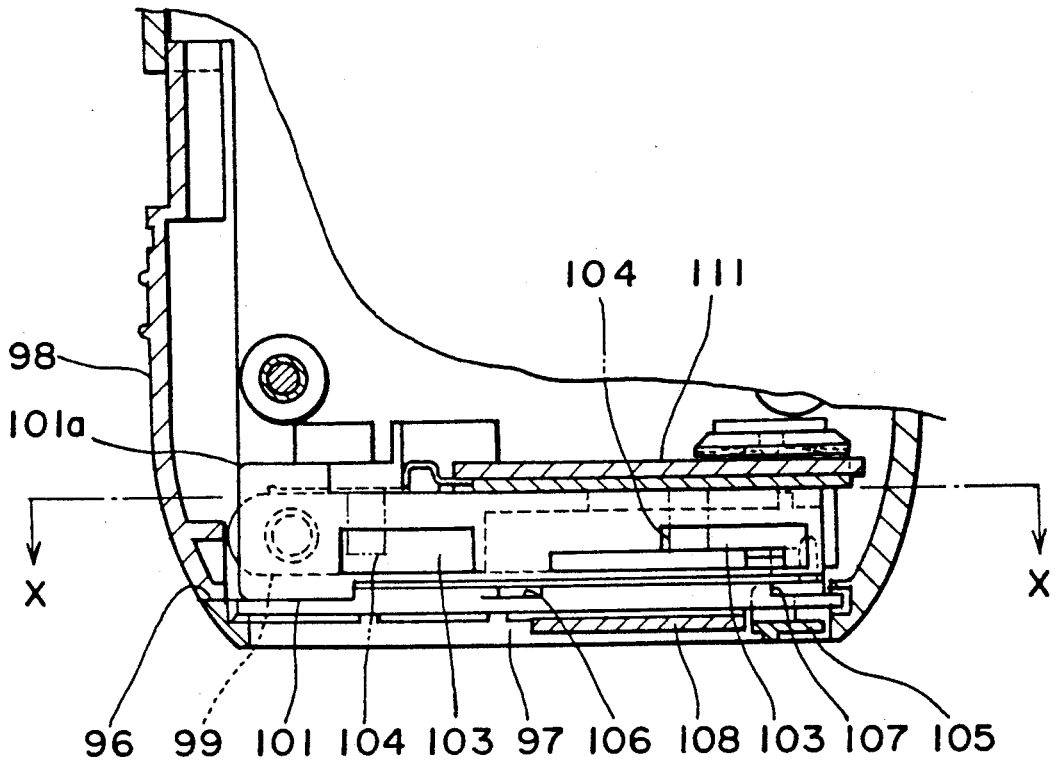
Figure 16:
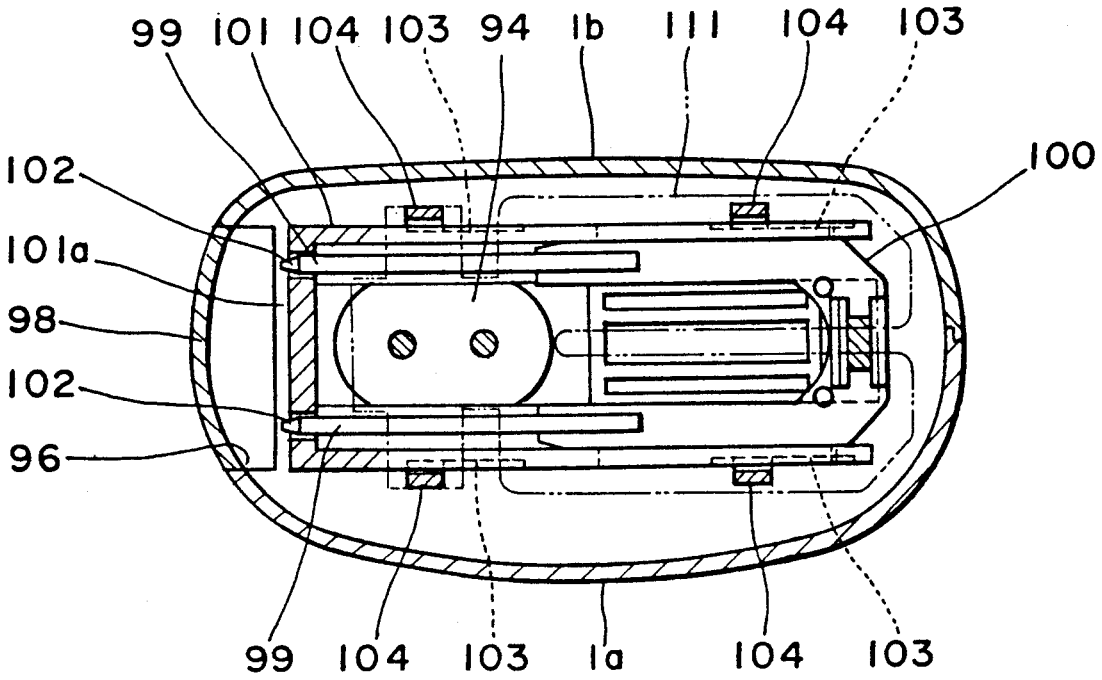

As shown in FIG. 15 and FIG. 16, the ]-shaped (in plan view) plug prong holder 101 is slidably engaged with the lower face of the plug base plate 111 for movement by a given stroke in the right and left direction across both the front and back sides of the stationary socket 94. The plug prong holder 101 is provided at its tip end 101*a* with a plug prong inserting hole 102, and is provided on the front and back faces with a hook engagement groove 103. The front and back side hook engagement grooves 103 are slidably engaged with the front and back hooks 104 projected downwardly from the front and back ends of the plug base plate 111.

The movable type plug 95 has a pair of plug prongs 99 extending front to back and a prong stand 100 integrally combined with the base end thereof. The movable type plug 95 has a plug prong 99 inserted into a plug prong insertion hole 102 of the plug prong holder 101 across both the front and back sides of the stationary type socket 94. An operation knob 105 is mounted on the bottom side of the prong stand 100. The operation knob 105 is integral with the movable type plug 95, is slidable in the right and left directions within the operation groove, and is detachably connectible respectively with the concave portions 106, 107 provided in the right and left positions of the operation groove 97.

When the operation knob 105 is engaged in the concave portion 107 at the right end of the operation groove 97 as shown in FIG. 15 and FIG. 16, the movable plug 95 is positioned such that the plug prong 99 and the plug prong holder 101 are retracted and accommodated within the plug opening 96.

Figure 17:
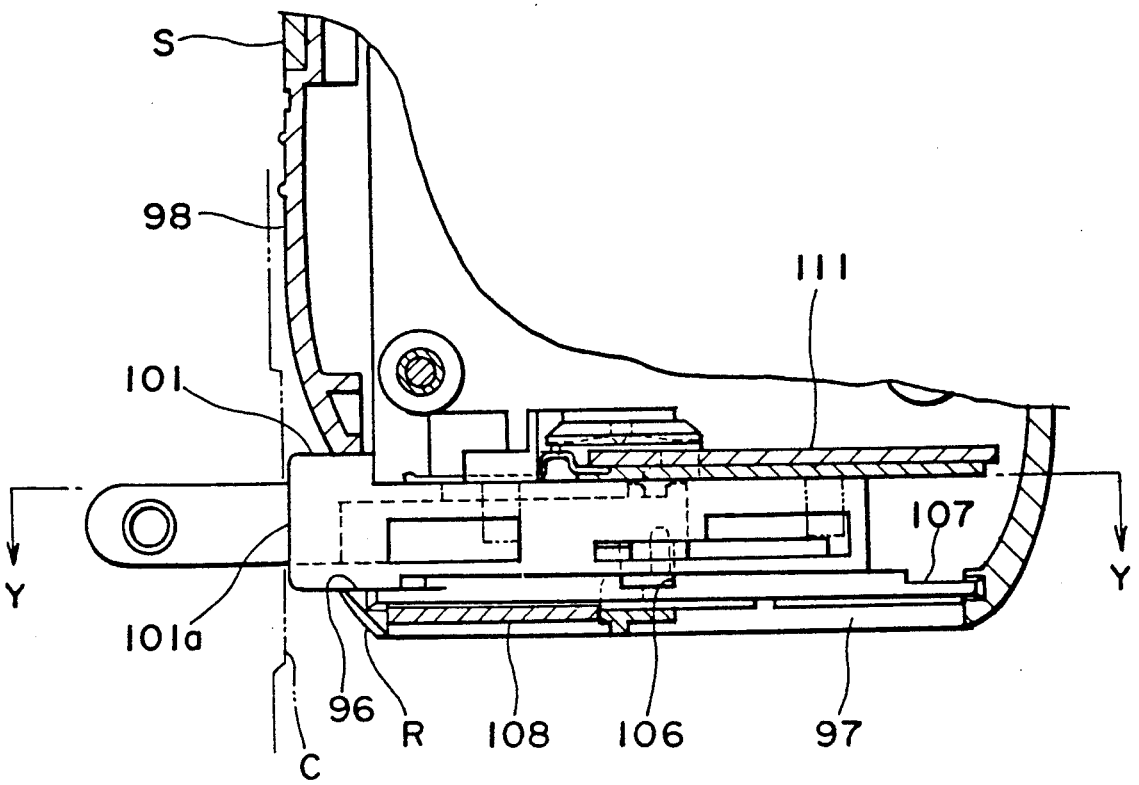
Figure 18:
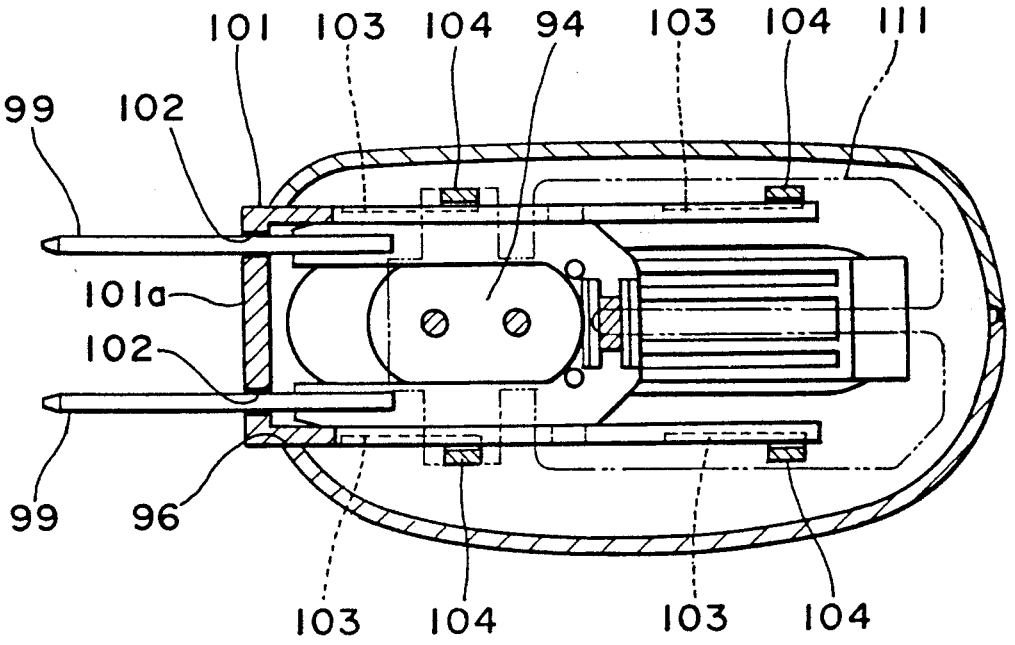

The plug cover 98 is slid upwardly to open the plug opening 96 and the operation knob 105 is slid in the left direction along the operation groove 97 after it has been disengaged from the concave portion 107 at the right end of the operation groove 97. The plug prong 99 is projected from the plug prong insertion hole 102 and the plug opening 96 until the right end of the hook engagement groove 103 reaches the hook 104. Upon further sliding of the operation knob 105 in the left direction it engages in the concave portion 106 at the left end of the operation groove 97, and the plug prong holder 101 is moved together with the plug prong 99 in that direction due to the engagement of the hook 104 and the right end of the interior of the hook engagement groove 103. As shown in FIG. 17 and FIG. 18, the plug prong 99 is projected from the plug opening 96 by a given projection amount. Also, the tip end 101*a* of the plug prong holder 101 is projected from the plug opening 96. In the projected condition of the plug prong holder 101, the flat tip end 101*a* is aligned with a straight line portion S which extends upwardly from a portion R of a curved sectional face corner of the main body case 1. Even when the plug prong 99 is projected from the plug opening 96 of the curved sectional corner during a charging operation, the tip end 101*a* of the plug prong holder 101 may be brought into face contact with a plug socket C (see the two-dot chain line in FIG. 17) in the wall so that a stable and reliable charging position is provided. When the movable plug 95 is used during charging the stationary type socket 94 is adapted to be closed by the socket cover 108 which is integrally formed on the bottom side of the prong stand 100. When the movable plug 95 is retracted into the plug opening 96, the operation knob 105 is slidably movable along the groove 97 until it becomes engaged in the concave portion 107 at the right end of the operation groove 97.

Figure 19:
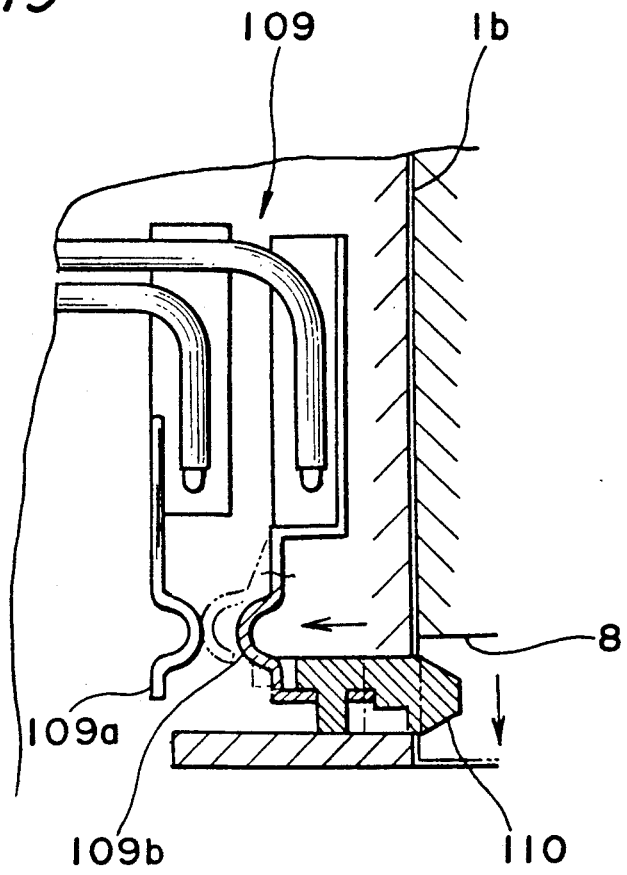

As shown in FIG. 19, a safety switch 109 is disposed within the back case 1*b*. A safety piece 110 of the safety switch 109 projects from one portion of the back case 1*b* and normally presses against the internal wall of the holder 8 when the external cutting edge holder 8 is engaged with the main body case 1 to bring the movable terminal 109*b* of the safety switch 109 into contact with the circuit. The pressure against the safety piece 110 is released when the external cutting edge holder 8 is disengaged from, and the movable terminal 109*b* is separated from, the stationary terminal 109*a* to open the power supply circuit. Accordingly, when the pressure against external cutting edge holder 8 is released (e.g. such as during a cleaning operation or the like), the rotary internal cutting edge 19 is prevented from rotating for safety reasons.

Figure 20:
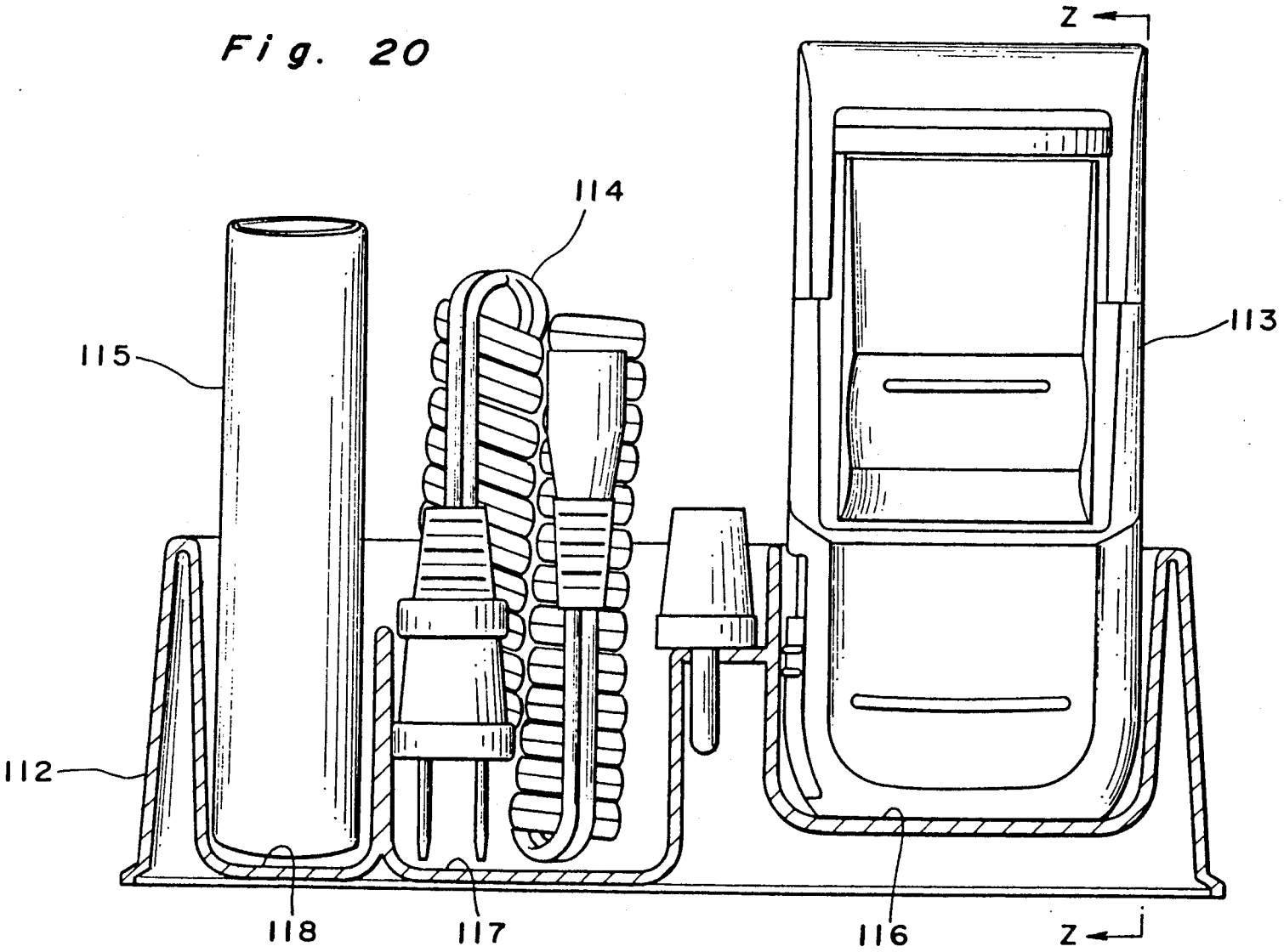
Figure 21:
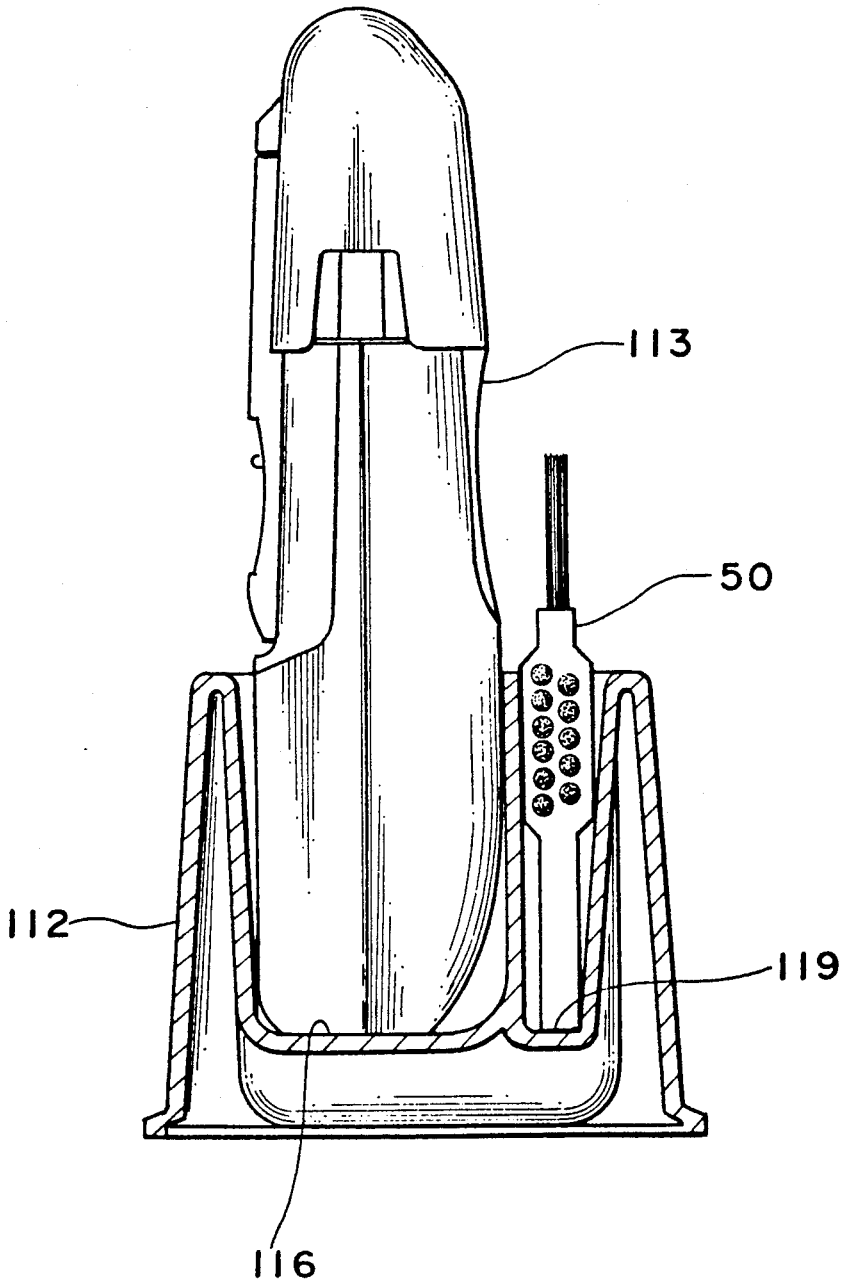

FIG. 20 and FIG. 21 show a stand 112. The stand 112 has concave portions 116, 117, 118, and 119 formed for accommodating in a leaning posture an electric razor 113 constructed as described hereinabove, a power supply cord 114, a brush 50 for use in cleaning, and a case 115 for accommodating the electric razor 113.

Figure 22:
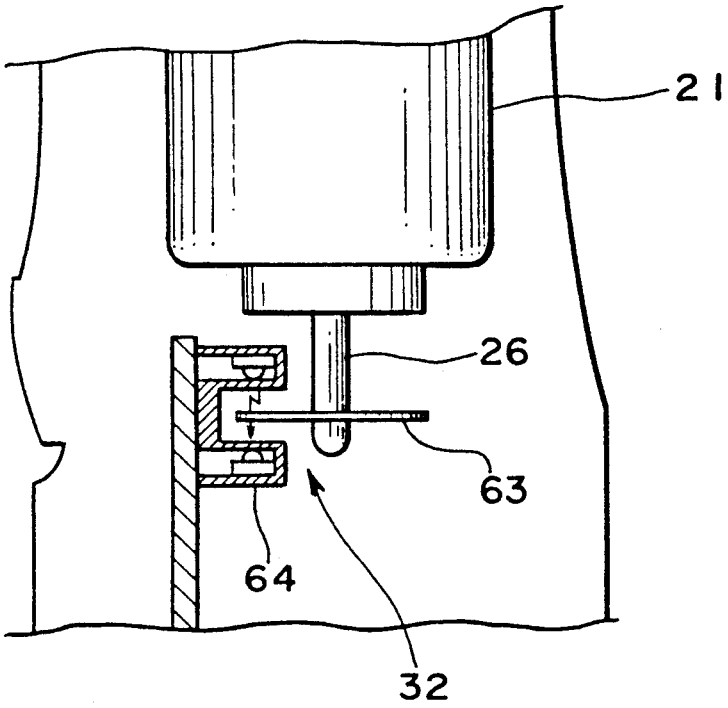
FIG. 22 is a front view of a motor revolution number detecting means portion according to another embodiment of the present invention.

Although the photosensor reflection 64 of the detecting means 32 has been described as a reflection sensor, a rotary member 63 can be mounted on the output shaft of the motor 21 and arranged between a pair of photosensor elements as elements a photointerruptor. The photosensor elements should include a light receiving element and a light emitting element opposite the light receiving element as shown in FIG. 22. A gear or a disc with a slit in it may be used as the rotary member 63.

Also, although in the above-described embodiment the number of the revolutions of the lower output shaft 26 of the motor 21 was detected, the number of revolutions of the upper output shaft 25 may alternatively be detected.

Figure 23:
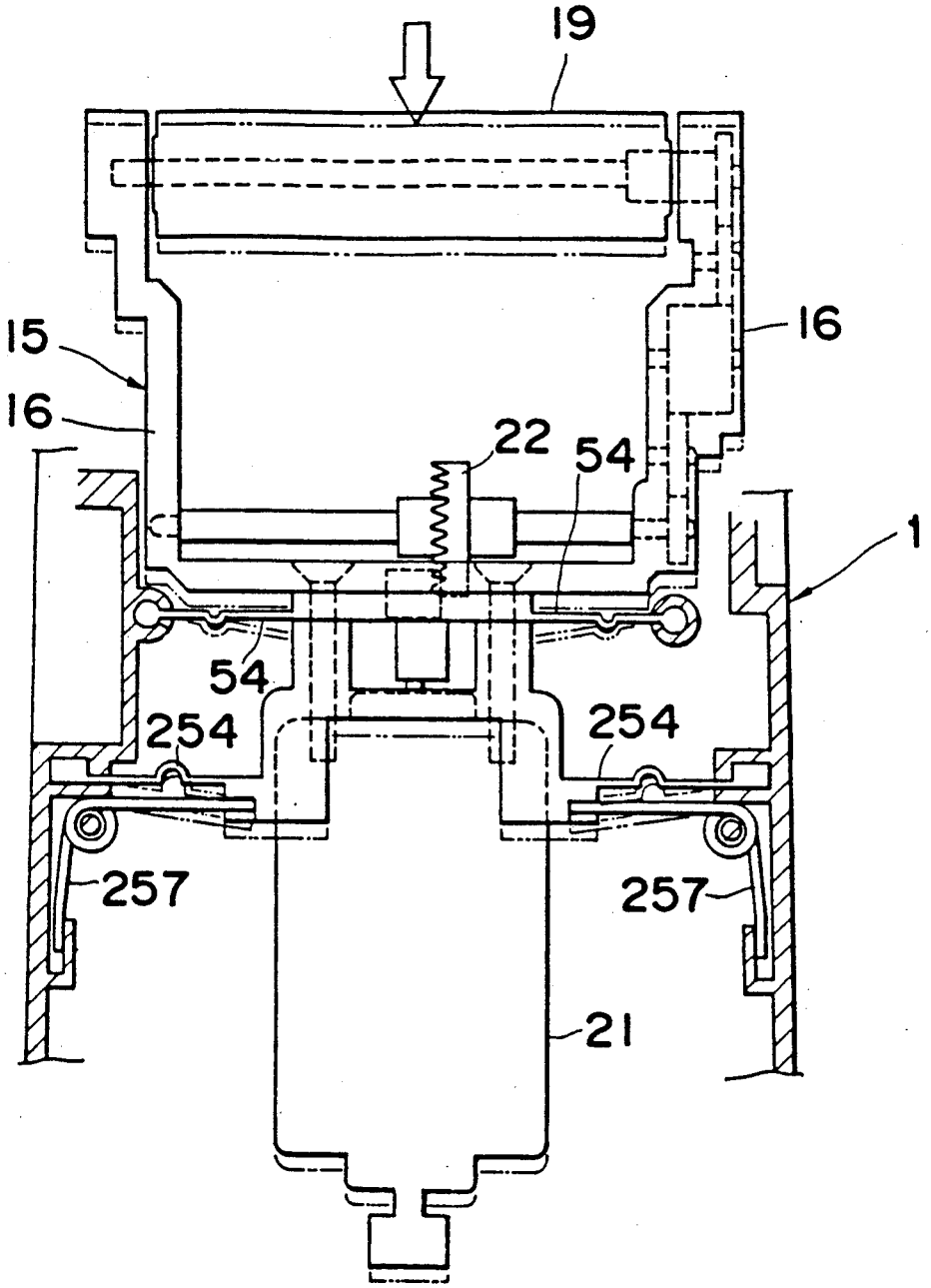
FIG. 23 is a view similar to FIG. 1(*b*) but showing a modification thereof.
Figure 24:
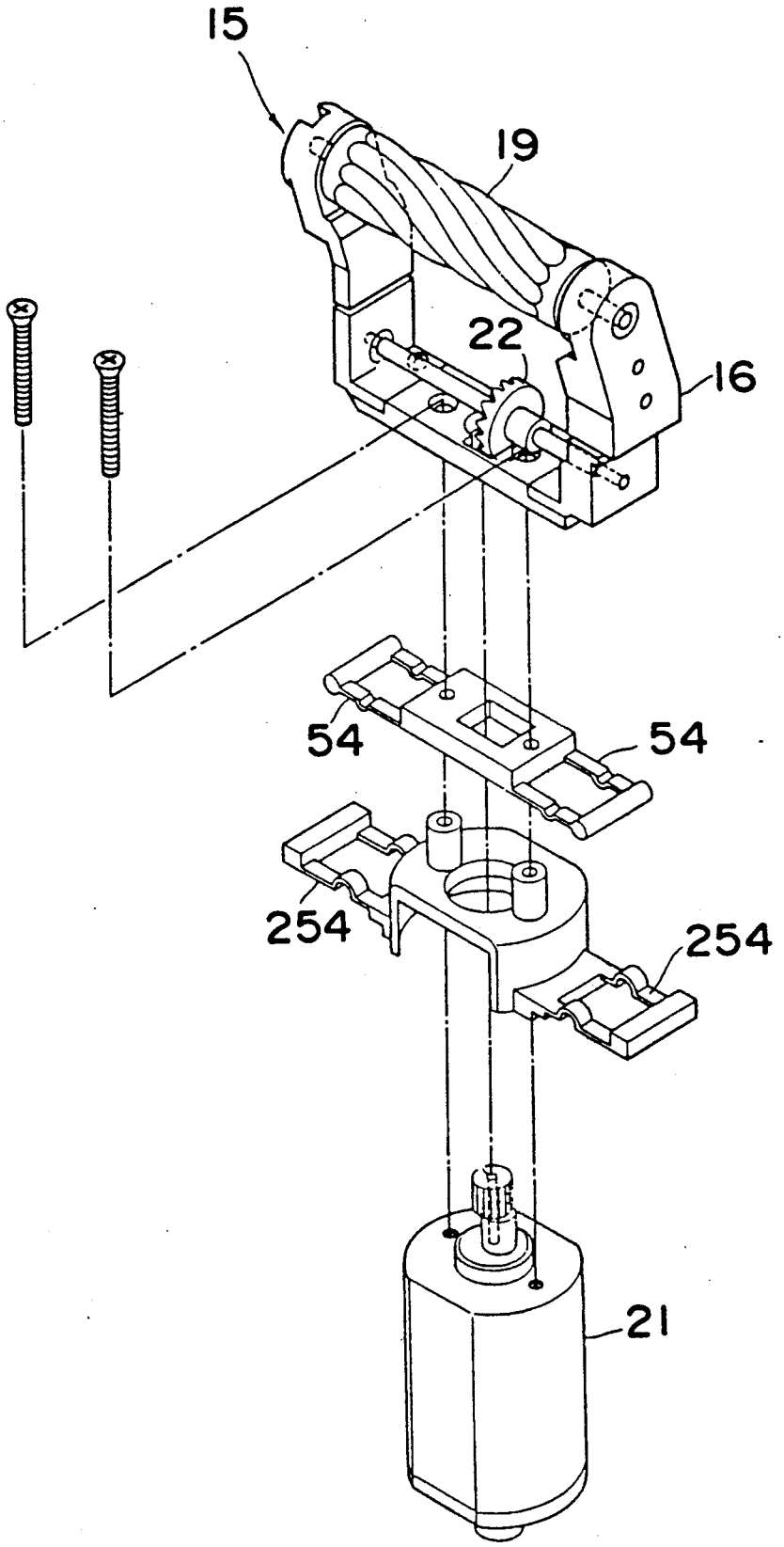
FIG. 24 is an exploded perspective view of the portion of FIG. 23.

As is clear from the foregoing description, according to the rotary type electric razor of the present invention, the internal cutting edge driving unit 15 can only be moved along a straight line in the veritical direction due to the vertical moving guide means 33 so as to limit the movement thereof in the longitudinal and right and left directions, so that the number of the revolutions of the motor 21 may be correctly detected by the detecting means 32. Since the vertical motion guide means 33 guides the motor 21 which is one of the components of the internal cutting edge driving unit 15, the guide means 33 does not interfere with the internal cutting edge driving system of the internal cutting edge driving unit 15. Also, since the motor 21 is operably connected with the internal cutting edge driving chassis 16, there is the advantage that the rotary internal cutting edge 19 can be stably and surely guided in the vertical direction so as to improve the cutting quality. Furthermore, as an alternative embodiment the internal cutting edge driving unit may be supported on the main case body 1 by a parallelogram link consisting of a pair of front and back supporting arms 54, 54 and 254, 254 and a pair of springs 257 provided between the body case 1 and the parallelogram link, as shown in FIGS. 23 and 24.

Although the present invention has been fully described by way of example with reference to the accompanying drawings, it is to be noted here that various changes and modifications will be apparent to those skilled in the art. Therefore, unless such changes and modifications depart from the scope of the present invention, they should be construed as included therein.

What is claimed is:

1. A rotary type electric razor comprising:

a main body case;

an arch-shaped external cutting edge mounted to an upper portion of said main body case;

an internal operation unit mounted for vertical movement within said main body case;

said internal operation unit comprising an internal cutting edge unit, an internal cutting edge support frame, a motor, a transmission operatively connected to said motor, and a floating support means for mounting said internal cutting edge unit, said internal cutting edge support frame, and said motor for vertical movement together within said main body case;

said internal cutting edge unit comprising a cylindrical rotary internal cutting edge adapted to rotate in sliding contact with an internal face of said external cutting edge, and a shaft rotatably mounting said internal cutting edge to said internal cutting edge support frame; and said transmission comprising transmitting means for transmitting drive from said motor to said internal cutting edge.

2. A rotary type electric razor as recited in claim 1, wherein said internal cutting edge support frame comprises a pair of spaced apart substantially vertical side frame members and a connecting member connecting said side frame members together; and said shaft for rotatably mounting said internal cutting edge is supported by said pair of side frame members.

3. A rotary type electric razor as recited in claim 1, further comprising spring means for urging said internal cutting edge unit upwardly so that said internal cutting edge contacts said internal face of said external cutting edge.

4. A rotary type electric razor as recited in claim 1, wherein said transmitting means comprises a gear unit mounted within one of said side frame members.

5. A rotary type electric razor as recited in claim 1, wherein said floating support means comprises a fixed portion connected to said motor, a thin portion extending from said fixed portion, and a fixed edge attached to the free end of said thin portion and mounted to said main body case.

6. A rotary type electric razor as recited in claim 5, wherein said fixed edge is mounted fixedly to said main body case.

7. A rotary type electric razor as recited in claim 1, wherein said floating support means comprises a fixed portion connected to said internal cutting edge unit, a thin portion extending from said fixed portion, and a fixed edged attached to the free end of said thin portion and mounted to said main body case.

8. A rotary type electric razor as recited in claim 7, wherein said fixed edge is mounted fixedly to said main body case.

9. A rotary type electric razor as recited in claim 1, wherein said internal cutting edge is detachably mounted to said internal cutting edge support frame, and said transmitting means is mounted within said internal cutting edge support frame.

10. A rotary type electric razor as recited in claim 9, further comprising locking means for locking said internal cutting edge to said internal cutting edge support frame and for maintaining said internal cutting edge in driving engagement with said transmitting means.

11. A rotary type electric razor as recited in claim 1, wherein said floating support means comprises a pair of parallel side-by-side links spaced apart from one another.

12. A rotary type electric razor as recited in claim 1, wherein said external cutting edge is formed of a mesh material.

13. A rotary type electric razor comprising:

a main body case;

an arch-shaped external cutting edge detachably mounted to an upper portion of said main body case;

an internal cutting edge support frame mounted within said main body case and including a pair of spaced apart substantially vertical side frame members;

a motor mounted within said main body case;

an internal cutting edge unit comprising a rotary internal cutting edge, a shaft projecting outwardly from opposing end faces of said internal cutting edge, and an internal cutting edge holder within which said internal cutting edge is removably held, said internal cutting edge holder comprising a first housing for supporting said shaft adjacent one end face of said internal cutting edge and a coupling frame extending from said first housing in a direction substantially parallel with said shaft;

a drive transmitting means mounted within one of said side frame members for transmitting drive from said motor to said internal cutting edge;

a housing receiving portion mounted to an upper end of one of said pair of side frame members and removably receiving said first housing;

a second housing mounted to an upper end of the other of said pair of side frame members, said second housing having a coupling hole therein through which a free end of said coupling frame is removably extended; and locking means for detachably locking said coupling frame in a position in which its free end extends through said coupling hole.

14. A rotary type electric razor as recited in claim 13, further comprising guide means for guiding said free end of said coupling frame through said coupling hole.

15. A rotary type electric razor as recited in claim 13, wherein said locking means includes a locking pawl adapted to engage said free end of said coupling frame, and a disengaging button for selectively disengaging said locking pawl from said free end of said coupling frame.

16. A rotary type electric razor as recited in claim 13, further comprising a bearing mounted in said first housing for receiving said shaft.

17. A rotary type electric razor as recited in claim 13, wherein said one of said pair of side frame members to which said housing receiving portion is mounted in the same one of said side frame members within which said drive transmitting means is mounted.

18. A rotary type electric razor as recited in claim 13, further comprising floating support means for mounting said internal cutting edge unit, said internal cutting edge support frame, and said motor within said main body case for vertical movement together relative to said main body case.

19. A rotary type electric razor comprising:

a main body case;

an arch-shaped external cutting edge detachably mounted to an upper portion of said main body case;

an internal cutting edge drive unit comprising a rotary internal cutting edge mounted for rotation in sliding contact with an internal face of said external cutting edge, an internal cutting edge driving chassis for rotatably supporting said rotary internal cutting edge, a motor mounted to said internal cutting edge driving chassis and having an output shaft, and drive transmitting means for transmitting drive from said motor to said internal cutting edge;

a vertical motion guiding means for limiting movement of said internal cutting edge drive unit to movement along a vertical direction, said guiding means being mounted between said motor and an internal face of said main body case; and motor speed detecting means for detecting a rotational speed of said output shaft of said motor, said detecting means comprising a rotary member mounted to said output shaft and a photosensor mounted within said main body case opposite said rotary member.

20. A rotary type electric razor as recited in claim 19, further comprising a floating support means for mounting said internal cutting edge, said internal cutting edge driving chassis, said motor, and said drive transmitting means within said main body case for vertical movement together relative to said main body case.

21. A rotary type electric razor as recited in claim 19, further comprising an internal cutting edge holder, within which said internal cutting edge is removably held, comprising a first housing for support one end of said internal cutting edge, and a coupling frame extending from said first housing in a direction substantially parallel to said internal cutting edge;

wherein said internal cutting edge driving chassis includes a pair of spaced apart substantially vertical side frame members;

a housing receiving portion is mounted to an upper end of one of said pair of said frame members and removably receives said first housing;

a second housing is mounted to an upper end of the other of said pair of side frame members, said second housing having a coupling hole therein through which a free end of said coupling frame is removably extended; and locking means is provided for detachably locking said coupling frame in a position in which its free end extends through said coupling hole.

* * * * *